US010597793B2

(12) United States Patent
Takahashi

(10) Patent No.: US 10,597,793 B2
(45) Date of Patent: Mar. 24, 2020

(54) PLATING APPARATUS AND RECORDING MEDIUM RECORDING PROGRAM THEREON

(71) Applicant: EBARA CORPORATION, Tokyo (JP)

(72) Inventor: Naoto Takahashi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 57 days.

(21) Appl. No.: 15/970,851

(22) Filed: May 3, 2018

(65) Prior Publication Data

US 2018/0363161 A1 Dec. 20, 2018

(30) Foreign Application Priority Data

Jun. 20, 2017 (JP) ..... 2017-120374

(51) Int. Cl.
*C25D 17/00* (2006.01)
*C25D 21/12* (2006.01)
*C25D 17/06* (2006.01)

(52) U.S. Cl.
CPC ..... *C25D 17/001* (2013.01); *C25D 17/008* (2013.01); *C25D 17/06* (2013.01); *C25D 21/12* (2013.01)

(58) Field of Classification Search
None
See application file for complete search history.

(56) References Cited

U.S. PATENT DOCUMENTS 10,273,594 B2 * 4/2019 Fujikata ..... C25D 17/001
2012/0258408 A1 * 10/2012 Mayer ..... C25D 21/12 430/325
2013/0255360 A1 * 10/2013 Minami ..... C25D 17/004 73/40.5 R
2017/0321344 A1 * 11/2017 Fendel ..... C25D 17/001
2019/0214318 A1 * 7/2019 Maslow ..... G03F 7/70683

FOREIGN PATENT DOCUMENTS

JP 2017-008347 1/2017

* cited by examiner

*Primary Examiner* — Nicholas A Smith
(74) *Attorney, Agent, or Firm* — JCIPRNET

(57) ABSTRACT

The disclosure improves a position confirmation method for members in a plating tank. A plating apparatus for applying a plating process on a substrate is provided. The plating apparatus includes a plating tank, a first member disposed in the plating tank, a second member disposed opposite to the first member in the plating tank, an optical sensor disposed on one of the first and second members, and a plurality of detected parts disposed on the other of the first and second members to be detectable by the optical sensor.

16 Claims, 13 Drawing Sheets

| Plating tank ID | Substrate holder ID | Target position of image identification marker | Y movement amount | Z movement amount | θ movement amount |
|---|---|---|---|---|---|
| t1 | h1 | (Y11a,Z11a)<br>(Y11b,Z11b) | ΔY11a<br>ΔY11b | ΔY11a<br>ΔY11b | ΔθY11a<br>ΔθY11b |
| t1 | h2 | (Y12a,Z12a)<br>(Y12b,Z12b) | ΔY12a<br>ΔY12b | ΔY12a<br>ΔY12b | ΔθY12a<br>ΔθY12b |
| | | | | | |
| t2 | h1 | (Y21a,Z21a)<br>(Y21a,Z21a) | ΔY21a<br>ΔY21b | ΔY21a<br>ΔY21b | ΔθY21a<br>ΔθY21b |
| | | | | | |

FIG. 8

| Plating tank ID | Substrate holder ID | Threshold value of each sensor (c, d) |
|---|---|---|
| t1 | h1 | c11, d11 |
| t1 | h2 | c12, d12 |
| | | |
| t2 | h1 | c21, d21 |
| | | |

PLATING APPARATUS AND RECORDING MEDIUM RECORDING PROGRAM THEREON

CROSS REFERENCE TO RELATED APPLICATIONS

This application claims the priority benefit of Japanese Patent Application No. 2017-120374, filed on Jun. 20, 2017. The entirety of the above-mentioned patent application is hereby incorporated by reference herein and made a part of this specification.

BACKGROUND

Technical Field

The disclosure relates to a plating apparatus and a recording medium recording a program thereon.

Description of Related Art

There is a type of plating apparatus, in which each substrate is held by a substrate holder and the substrate holder is immersed in a plating tank to perform a plating process. For this type of plating apparatus, it is necessary to strictly adjust the relative positions of the substrate and the regulation plate in order to achieve a favorable plating film thickness distribution. However, due to the individual difference of each substrate holder, vibration caused by earthquake, etc., or deformation of the substrate holder caused by other damages, for example, the substrate holder may slightly deviate in position when immersed in the plating solution. Thus, the plating apparatus disclosed in Japanese Laid-open Patent Application No. 2017-8347 (Patent Literature 1), for example, performs position adjustment for the substrate holder in advance.

[Patent Literature 1] Japanese Laid-open Patent Application No. 2017-8347

SUMMARY

Nevertheless, the adjustment method of Patent Literature 1 requires a dedicated jig to place the substrate holder, etc. The disclosure solves at least some of the aforementioned problems.

According to an embodiment of the disclosure, a plating apparatus for applying a plating process on a substrate is provided. The plating apparatus includes a plating tank; a first member disposed in the plating tank; a second member disposed opposite to the first member in the plating tank; an optical sensor disposed on one of the first member and the second member; and a plurality of detected parts disposed on the other of the first member and the second member to be detectable by the optical sensor. According to an embodiment of the disclosure, the relative positions and/or orientation of the first member and the second member can be detected and/or adjusted without using a dedicated jig. The "opposite to" also includes a case where the first member and the second member are opposite to each other with another member interposed therebetween.

According to an embodiment of the disclosure, a plating apparatus for applying a plating process on a substrate by using a substrate holding member is provided. The plating apparatus includes a plating tank; a first member disposed in the plating tank at a position opposite to the substrate holding member when the substrate holding member is placed in the plating tank; an optical sensor disposed on one of the substrate holding member and the first member; and a plurality of detected parts disposed on the other of the substrate holding member and the first member to be detectable by the optical sensor. The "opposite to" also includes a case where the substrate holding member and the first member are opposite to each other with another member interposed therebetween.

According to an embodiment of the disclosure, since the optical sensor is disposed on one of the substrate holding member and the first member while the detected part is disposed on the other, whether the substrate holding member is placed in the predetermined position in the plating tank can be confirmed without using a dedicated jig. Moreover, whether the substrate holding member is in the predetermined position in the plating tank can be confirmed every time the substrate holding member is placed in the plating tank. Since the position of the substrate holding member can be detected and confirmed every time the substrate holding member is placed in the plating tank, positioning abnormality can be detected in an early stage. As a result, the uniformity of the plating film thickness formed by the plating process can be improved and the yield can be prevented from dropping. In addition, according to an embodiment of the disclosure, for each plating process (every time the substrate holding member is placed in the plating tank), it is possible to directly check the position of the substrate holding member prior to the plating process without stopping the plating apparatus.

BRIEF DESCRIPTION OF THE DRAWINGS

FIG. 8 is a configuration example of the alignment data according to the first embodiment.

DESCRIPTION OF THE EMBODIMENTS (Plating Apparatus)

Figure 1:
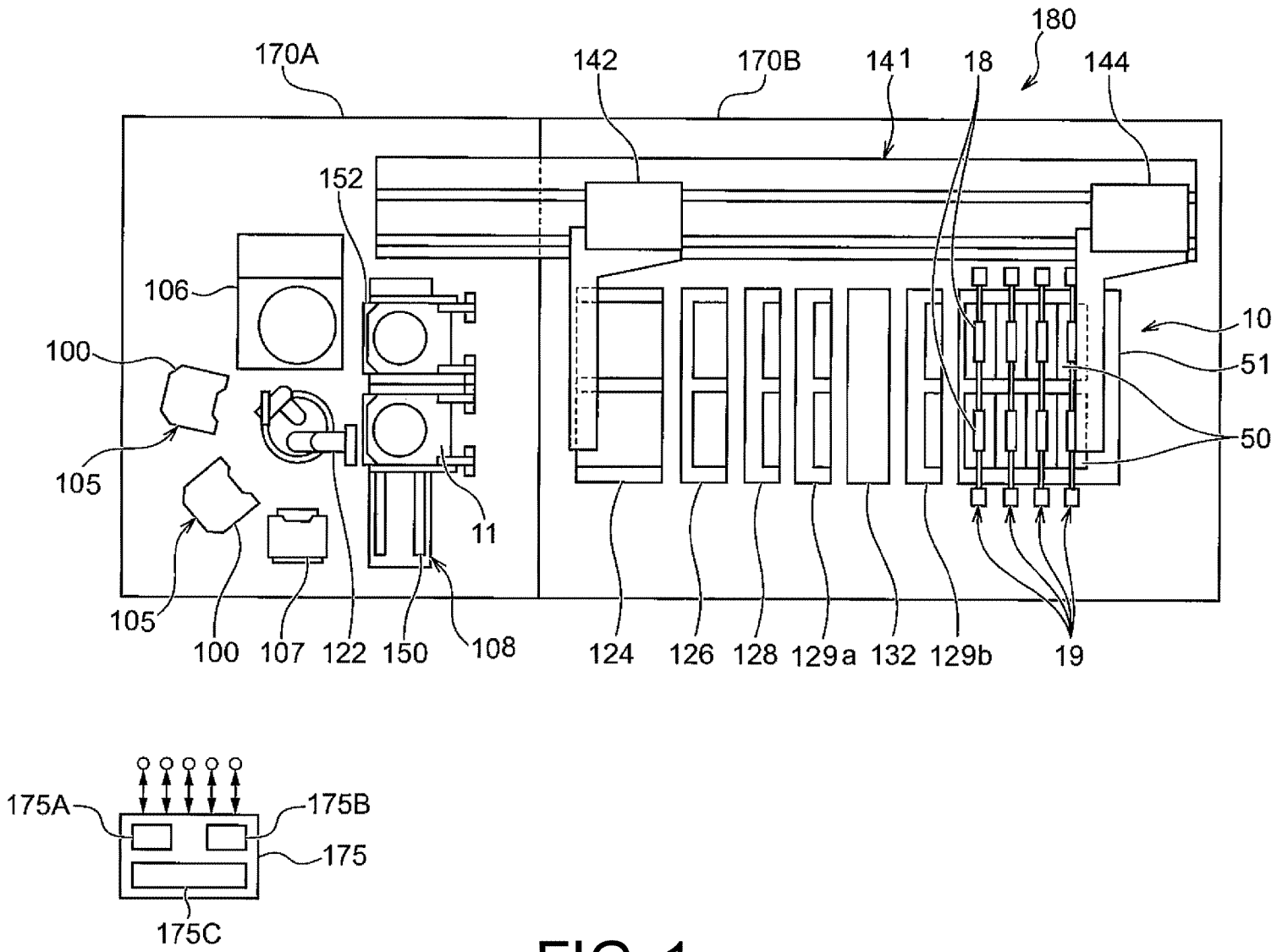
FIG. 1 is an overall layout view of the plating apparatus according to an embodiment of the disclosure.

FIG. 1 is an overall layout view of a plating apparatus according to an embodiment of the disclosure. As shown in FIG. 1, the plating apparatus 1 includes a loading/unloading part 170A and a plating processing part 170B. The loading/unloading part 170A is for loading a substrate W, which is an object to be plated such as a semiconductor wafer, onto a substrate holder 11 and unloading the substrate W from the substrate holder 11. The plating processing part 170B is for processing the substrate W.

The loading/unloading part 170A includes two cassette tables 105, an aligner 107 for aligning the positions of orientation flat, notch, etc. of the substrate W with a predetermined direction, and a spin rinse dryer 106 for rotating the substrate W receiving the plating process at a high speed to dry the substrate W. The cassette table 105 carries a cassette 100 that stores the substrate W, such as a semiconductor wafer. Although two cassette tables 105 are illustrated here, one, three, or more cassette tables may be used. Near the spin rinse dryer 106, a substrate attachment/detachment part (fixing station) 108 is provided for mounting the substrate holder 11 to attach or detach the substrate W. At the center of these parts, i.e., the cassette tables 105, the aligner 107, the spin rinse dryer 106, and the substrate attachment/detachment part 108, a substrate transport device 122 is disposed. The substrate transport device 122 is composed of a transport robot for transporting the substrate W among these parts.

The substrate attachment/detachment part 108 includes a flat mounting plate 152 that is slidable along a rail 150 in a lateral direction. Two substrate holders 11 are mounted in parallel on the mounting plate 152 in a horizontal state. After the substrate W is delivered between one substrate holder 11 and the substrate transport device 122, the mounting plate 152 is slid in the lateral direction to carry out delivery of the substrate W between the other substrate holder 11 and the substrate transport device 122. The substrate attachment/detachment part 108 may be a device for attaching or detaching the substrate with the substrate holder 11 upright.

In this application, the term "substrate" includes not only a semiconductor substrate, a glass substrate, or a printed circuit board (a printed substrate), but also a magnetic recording medium, a magnetic recording sensor, a mirror, an optical element or a micro-mechanical element, or a partially fabricated integrated circuit. This embodiment illustrates an example that the substrate W is a rectangular substrate having a rectangular shape. Nevertheless, the shape of the substrate to be used, and the shapes of the openings of the substrate holder and the regulation plate are not particularly limited and may be any shape, such as a non-circular shape, a square, a rectangle, and other polygonal shapes.

The processing part 170B of the plating apparatus 1 includes a stocker 124, a pre-wetting tank 126, a pre-soaking tank 128, a first cleaning tank 129*a*, a blow tank 132, a second cleaning tank 129*b*, and a plating tank part 10. The substrate holder 11 is stored and temporarily placed in the stocker (also referred to as a stocker container installation part) 124. In the pre-wetting tank 126, the substrate W is immersed in pure water. In the pre-soaking tank 128, an oxide film on the surface of a conductive layer, such as a seed layer, formed on the surface of the substrate W is removed by etching. In the first cleaning tank 129*a*, the substrate W that has been pre-soaked is cleaned together with the substrate holder 11 with a cleaning liquid (pure water, etc.). In the blow tank 132, the substrate W that has been cleaned is drained. In the second cleaning tank 129*b*, the substrate W that has been plated is cleaned together with the substrate holder 11 with the cleaning liquid. Nevertheless, the aforementioned configuration of the processing part 170B of the plating apparatus 1 is merely an example, and the processing part 170B of the plating apparatus 1 is not limited to such a configuration and may use other configurations.

The plating tank part 10 has a plurality of plating tanks 50 provided with an overflow tank 51, for example. One substrate W is stored in each plating tank 50, and the substrate W is immersed in the plating solution contained in each plating tank 50 to perform a process of plating copper, gold, silver, solder, nickel, etc. onto the surface of the substrate W. Here, the plating solution is not limited to a certain type, and various plating solutions may be used according to the purposes. In the case of a copper plating process, for example, the plating solution usually contains chemical species called an inhibitor (surfactant, etc.) acting to adsorb onto copper surface via chlorine, a promoter (organic sulfur compound, etc.) acting to promote concave plating, and a smoothing agent (quaternary amine, etc.) for suppressing the precipitation promoting effect of the promoter and improving the flatness of film thickness.

Regarding the plating solution, a plating solution containing CoWB (cobalt•tungsten•boron), CoWP (cobalt•tungsten•phosphorus), etc. for forming a metal film on the surface of the substrate W having Cu wiring may be used. Additionally, in order to prevent Cu from diffusing into the insulating film, a plating solution, such as a plating solution containing CoWB, may be used for forming a barrier film to be disposed on the surface of the substrate W or the surface of a concave of the substrate W before the Cu wiring is formed.

The plating apparatus 1 has a substrate holder transport device 141, which is positioned beside each of these devices (the stocker 124, the pre-wetting tank 126, the pre-soaking tank 128, the first cleaning tank 129*a*, the blow tank 132, the second cleaning tank 129*b*, the plating tank part 10, and the substrate attachment/detachment part 108) and transports the substrate holder 11 together with the substrate W among these devices, for example, by using a linear motor system. The substrate holder transport device 141 has a first transporter 142 and a second transporter 144. The first transporter 142 is configured to transport the substrate W among the substrate attachment/detachment part 108, the stocker 124, the pre-wetting tank 126, the pre-soaking tank 128, the first cleaning tank 129*a*, and the blow tank 132, for example. The second transporter 144 is configured to transport the substrate W among the first cleaning tank 129*a*, the second cleaning tank 129*b*, the blow tank 132, and the plating tank part 10, for example. In another embodiment, the first transporter 142 and the second transporter 144 may transport the substrate W between parts of other combinations. In another embodiment, the plating apparatus 1 may include only one of the first transporter 142 and the second transporter 144.

In each plating tank 50, a paddle device 180 is disposed for stirring the plating solution in the plating tank 50. The paddle device 180 includes a paddle 18 serving as a stirring bar for stirring the plating solution, and a paddle driving device 19 disposed on two sides of the overflow tank 51 to drive the paddle 18.

A plating processing system including a plurality of the plating processing apparatuses configured as described above has a controller 175 that is configured to control each of the aforementioned parts. The controller 175 includes a memory 175B, a CPU 175A, and a control part 175C. The memory 175B includes a recording medium that stores one or a plurality of pieces of setting data and one or a plurality of programs. The CPU 175A executes the program in the memory 175B. The control part 175C is realized when the CPU 175A executes the program. A part of the control part 175C may be configured with dedicated hardware, such as an application specific integrated circuit, e.g., ASIC, PLC, or the like. Moreover, the controller 175 is configured to be capable of communicating with a host controller (not shown) that comprehensively controls the plating apparatus 1 and other related devices, and can exchange data with a database of the host controller.

The programs include programs for controlling transport of the substrate transport device 122, transport of the substrate holder transport device 141, the plating current and plating time in the plating tank part 10, and the opening diameter of the regulation plate and the opening diameter of an anode mask (not shown) disposed in each plating tank 50, for example. Additionally, the programs include a program for controlling position detection of the substrate holder 11 in each plating tank 50, and a program for controlling the positioning (alignment) of the substrate holder 11 in each plating tank 50. A memory, such as a computer readable ROM or RAM, or a known device, such as a disk-shaped storage medium, e.g., a hard disk, CD-ROM, DVD-ROM, or a flexible disk, may be used as the storage medium of the memory 175B.

(Plating Tank)

Figure 2:
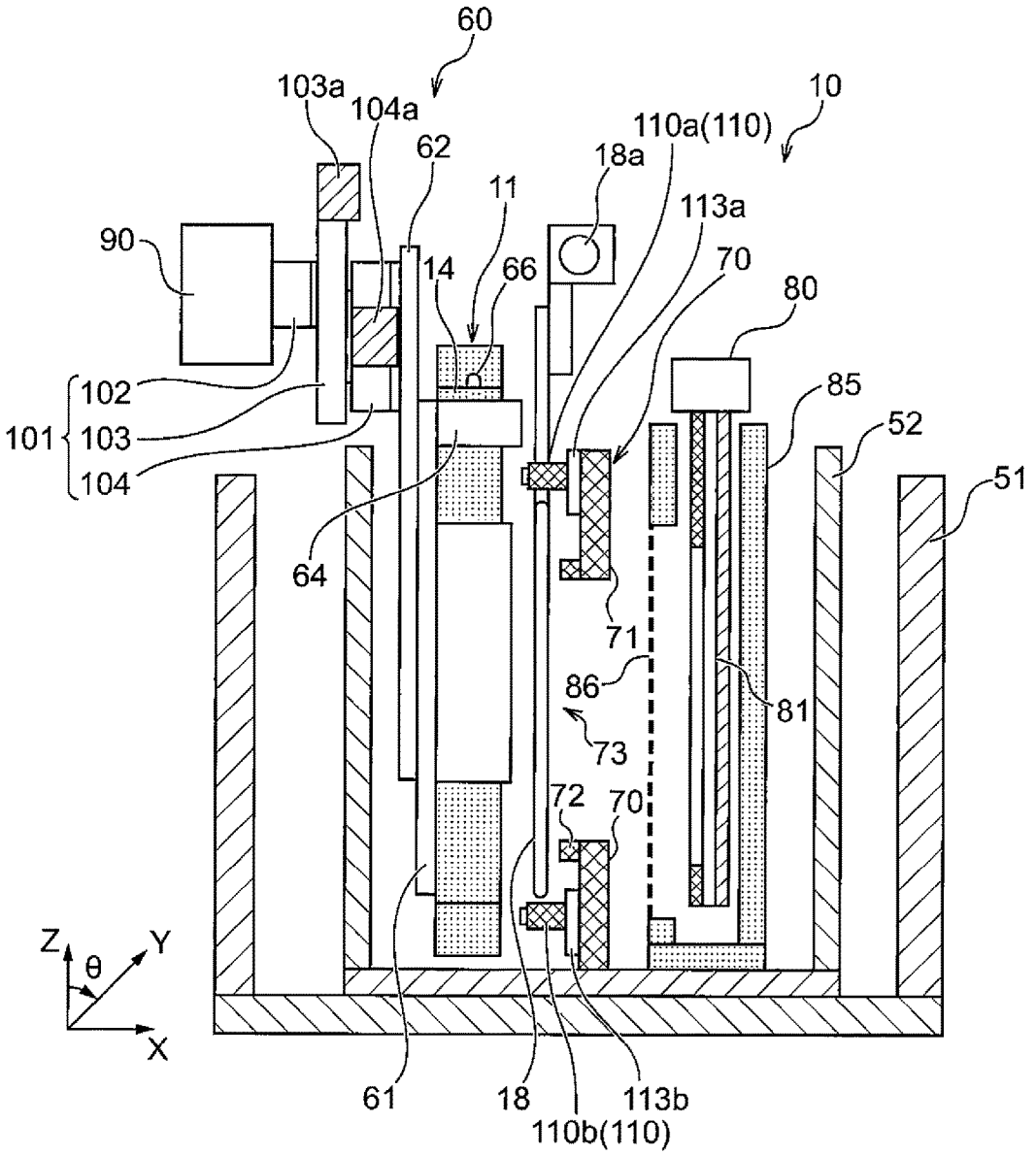
FIG. 2 is a schematic cross-sectional side view showing the plating tank of the plating apparatus according to the first embodiment.
Figure 3:
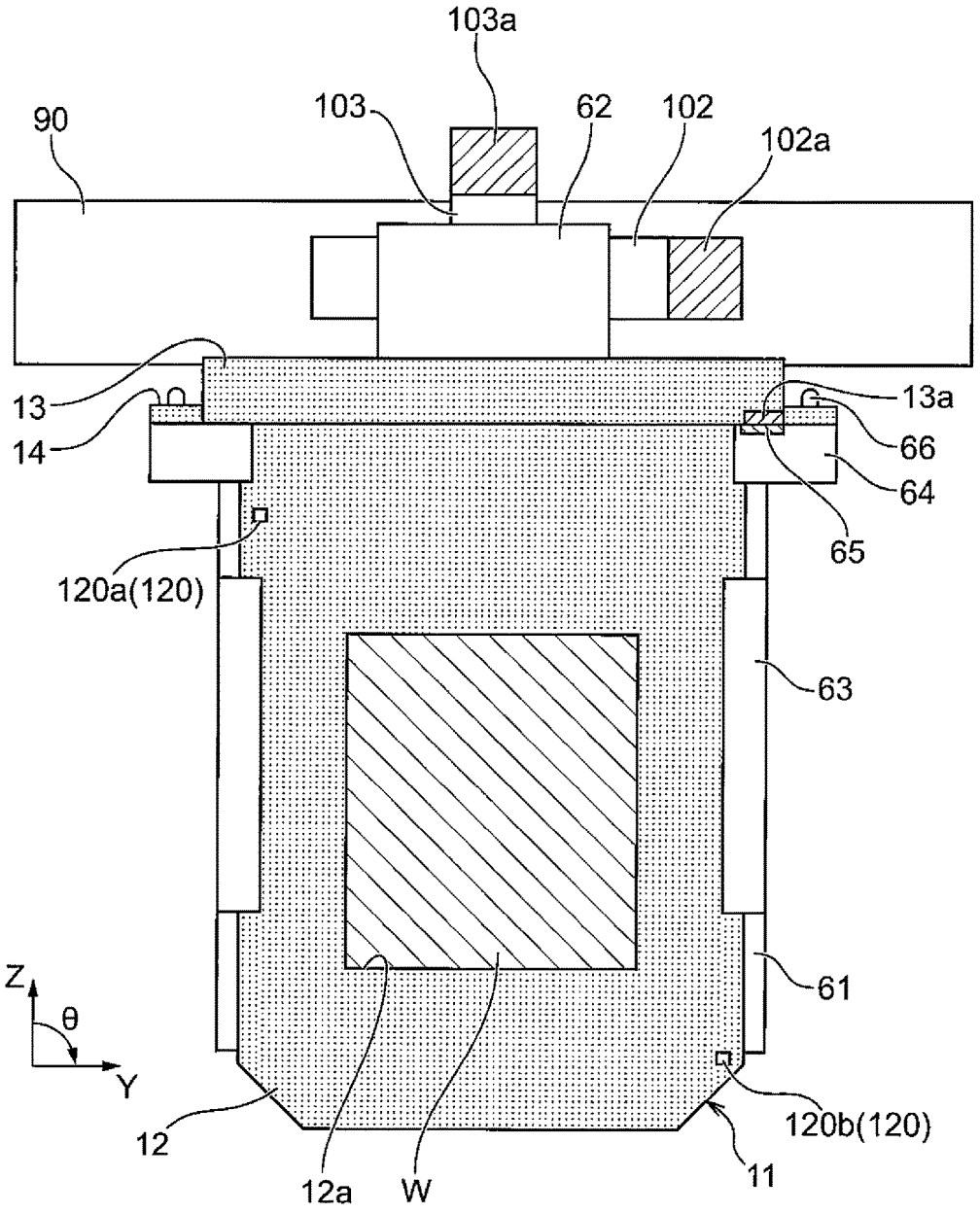
FIG. 3 is a front view of the substrate holder and the support mechanism thereof according to the first embodiment.
Figure 4:
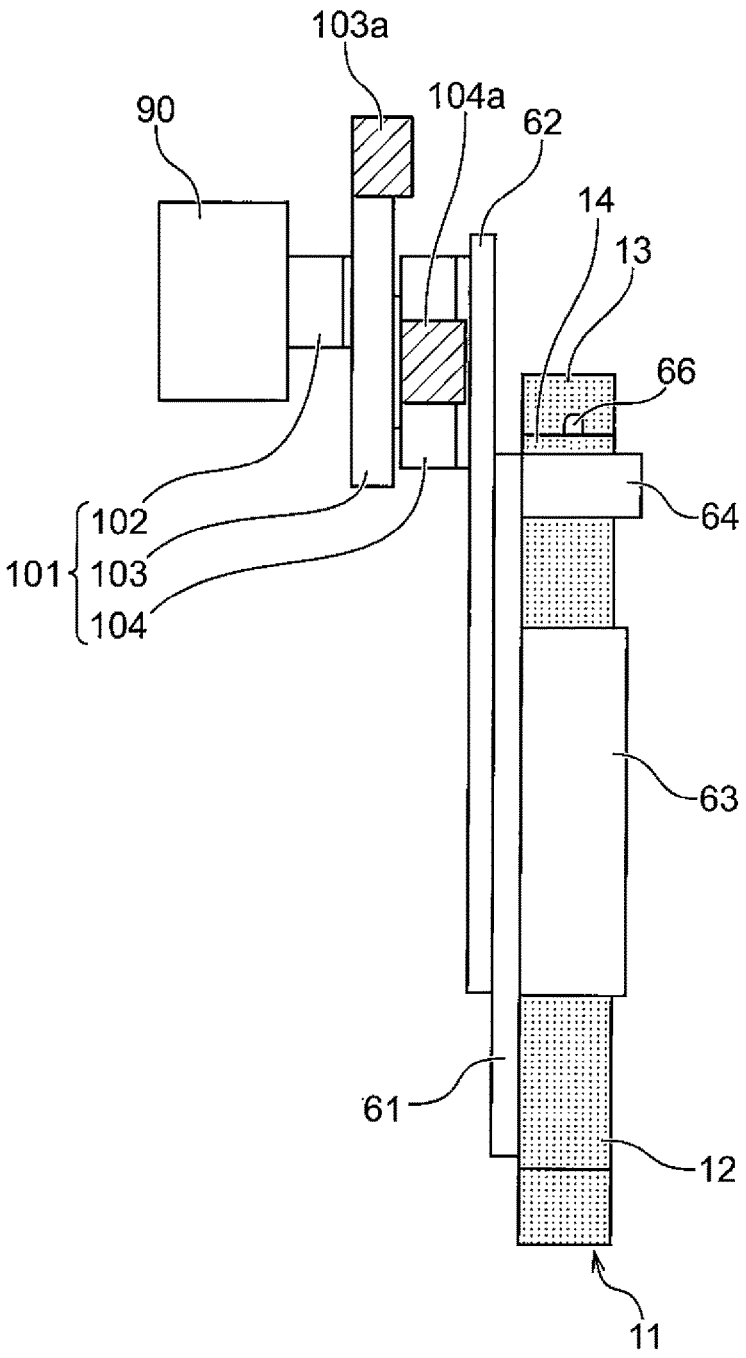
FIG. 4 is a side view of the substrate holder and the support mechanism thereof according to the first embodiment.
Figure 5:
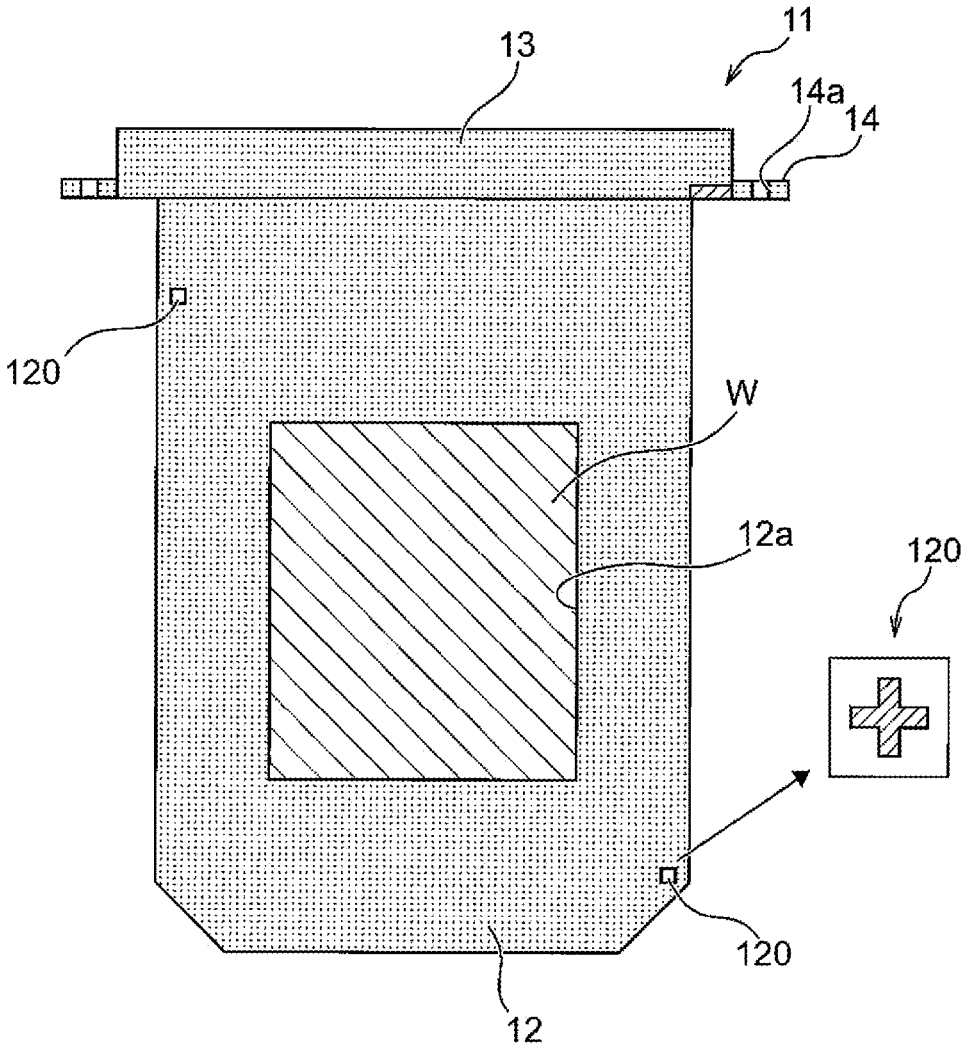
FIG. 5 is a front view of the substrate holder according to the first embodiment.
Figure 6:
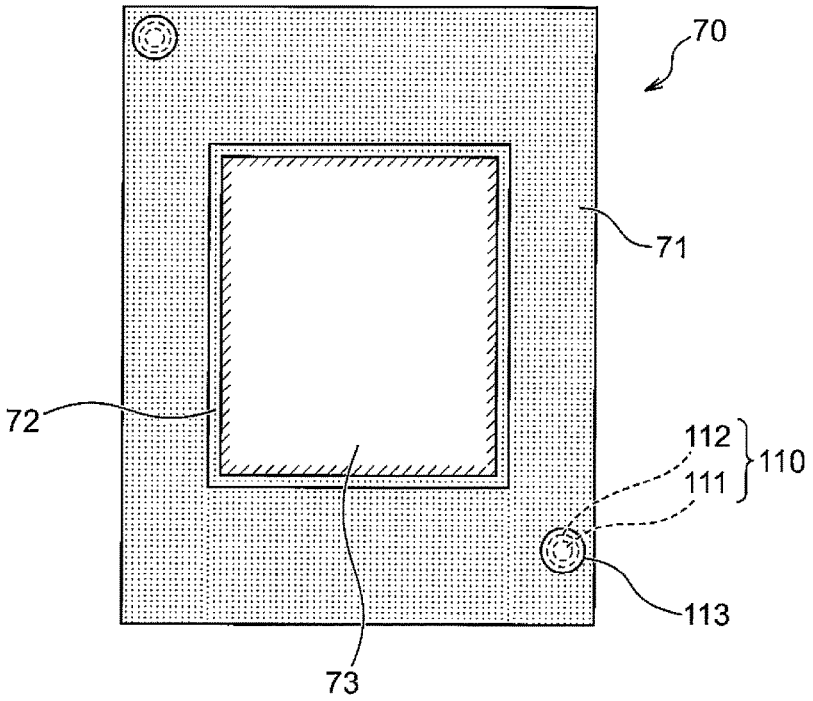
FIG. 6 is a front view of the regulation plate according to the first embodiment.

FIG. 2 is a schematic cross-sectional side view showing the plating tank of the plating apparatus according to the first embodiment. FIG. 3 is a front view of a substrate holder and a support mechanism thereof according to the first embodiment. FIG. 4 is a side view of the substrate holder and the support mechanism thereof according to the first embodiment. FIG. 5 is a front view of the substrate holder according to the first embodiment. FIG. 6 is a front view of the regulation plate according to the first embodiment.

Each plating tank 50 of the plating tank part 10 includes an inner tank 52 for storing the plating solution (not shown) therein, and a plurality of constituent members disposed in the inner tank 52. The inner tank 52 is disposed in the overflow tank 51 that receives the plating solution overflowing from the edge of the inner tank 52. The bottom portion of the overflow tank 51 and the bottom portion of the inner tank 52 are connected by a plating solution supply passage (not shown). A pump is disposed in the plating solution supply passage, and the plating solution accumulated in the overflow tank 51 is recirculated to the inner tank 52 by the pump. Furthermore, a constant temperature part for adjusting the temperature of the plating solution may be disposed in the plating solution supply passage on the downstream side of the pump, for example. In addition, a filter for filtering and removing foreign matters in the plating solution may be disposed in the plating solution supply passage on the downstream side of the pump, for example.

A holder guide 60 for supporting the substrate holder 11 that holds the substrate W, the paddle 18 for stirring the plating solution, a regulation plate 70, and an anode holder 80 are disposed in the inner tank 52 of each plating tank 50.

As shown in FIG. 3, the substrate holder 11 includes a first plate 12 that has an opening 12*a*, a second plate (not shown), and a hanger part 13 disposed on an end portion of the first plate and/or the second plate. The first plate 12 and the second plate clamp and hold the substrate W. The opening 12*a* exposes a part of the surface of the substrate W. The hanger part 13 is provided with an external connection terminal 13*a*. Furthermore, positioning parts 14 that are thinner than other portions are provided on two sides of the hanger part 13, and a positioning hole 14*a* (FIG. 5) is formed on each positioning part 14. In addition, image identification markers 120 (120*a*, 120*b*) (FIG. 5) are provided on the first plate 12 of the substrate holder 11. In this embodiment, two image identification markers 120*a* and 120*b* are disposed on the substrate holder 11. In this embodiment, the image identification markers 120*a* and 120*b* are disposed on two sides of one diagonal line of the substrate holder 11 (on the diagonal line of the substrate W). It is also possible to dispose one, three, or more image identification markers 120. In addition to the configuration related to the diagonal line, the one or a plurality of image identification markers 120 can be disposed at any position of the substrate holder 11 on the side of the regulation plate 70. The image identification markers 120 may be attached to the substrate holder 11 or be formed integrally with the substrate holder 11.

The holder guide 60 includes a support plate 61, an attachment part 62, a guide rail 63, and a hanger receiving part 64. The support plate 61 supports the substrate holder 11 on the side of the second plate when the substrate holder 11 is installed on the holder guide 60. The attachment part 62 is attached to the support plate 61, and attaches the holder guide 60 to actuators 101 (will be described later). The guide rail 63 guides two sides of the substrate holder 11 and restricts movement of the substrate holder 11 in the left-right direction and the front-rear direction. The hanger receiving part 64 is disposed on two sides of the upper end portion of the support plate 61 and has a receiving surface, on which two sides of the hanger part 13 of the substrate holder 11 are disposed. A positioning pin 66 for positioning the substrate holder 11 is provided on the receiving surface of each hanger receiving part 64. Additionally, a current supply terminal 65 is provided on the receiving surface of the hanger receiving part 64 to be connected to the external connection terminal 13*a* of the substrate holder 11.

The substrate holder 11 is lowered so as to be guided by the guide rail 63 from above to the holder guide 60, and the hanger part 13 of the substrate holder 11 is mounted on the hanger receiving part 64 of the holder guide 60. At this time, the positioning pin 66 of the holder guide 60 is fitted into the positioning hole 14*a* of the substrate holder 11, and the substrate holder 11 is positioned with respect to the holder guide 60. Besides, the external connection terminal 13*a* of the substrate holder 11 is connected to the current supply terminal 65 of the holder guide 60.

In the case where the actuators 101 (will be described later) are not provided, the substrate holder 11 may be suspended directly in the inner tank 52 without the holder guide 60.

As shown in FIG. 2, the holder guide 60 is connected to the actuators 101 in the attachment part 62. The actuators 101 are fixed to a support frame 90. The actuators 101 include an actuator 102 for moving the holder guide 60 in the left-right direction (Y-axis direction), an actuator 103 for moving the holder guide 60 in the up-down direction (Z-axis direction), and an actuator 104 for moving the holder guide 60 in a rotational direction (θ direction) in the Y-Z plane.

The actuator 102 includes a servo motor 102*a* and a rotational/linear motion conversion mechanism (not shown) for converting the rotational motion of the servo motor 102*a* into a reciprocating motion. The actuator 102 includes a deceleration mechanism for decelerating the rotational motion of the servo motor 102*a*, if necessary. The actuator 102 adjusts the position of the holder guide 60 in the Y-axis direction by the reciprocating motion of the rotational/linear motion conversion mechanism. The actuator 103 includes a servo motor 103*a* and a rotational/linear motion conversion mechanism (not shown) for converting the rotational motion of the servo motor 103*a* into a reciprocating motion. The actuator 103 includes a deceleration mechanism for decelerating the rotational motion of the servo motor 103*a*, if necessary. The actuator 103 adjusts the position of the holder guide 60 in the Z-axis direction by the reciprocating motion of the rotational/linear motion conversion mechanism. The actuator 104 includes a servo motor 104*a*, and includes a deceleration mechanism for decelerating the rotational motion of the servo motor 104*a*, if necessary. The actuator 104 adjusts the position of the holder guide 60 in the θ direction by the rotational motion from the servo motor 104*a*.

As shown in FIG. 2, the paddle 18 is disposed between the holder guide 60 and the regulation plate 70, and reciprocates in parallel to the surface of the substrate W to stir the plating solution. The paddle 18 is fixed to a shaft 18*a* and reciprocates when the shaft 18*a* is driven by the paddle driving device 19 (FIG. 1). The paddle 18 is made of a rectangular plate-shaped member that has a constant plate thickness, and is configured to have a plurality of lattice parts extending in the vertical direction by disposing a plurality of elongated holes in parallel in the plate-shaped member. The material of the paddle 18 is obtained by applying a Teflon (registered trademark) coat to titanium, for example. The paddle 18 is disposed in the inner tank 52 with a shape and configuration that do not interfere with the path between the sensor parts 110 (110*a*, 110*b*) (FIG. 6) on the regulation plate 70 and the image identification markers 120 on the substrate holder 11.

The regulation plate 70 is a member composed of a dielectric (e.g., vinyl chloride) for making the potential distribution over the entire surface of the substrate W more uniform. The regulation plate 70 includes a shielding plate 71, an annular protrusion 72, and an opening 73 that passes through the shielding plate 71 and the annular protrusion 72. The regulation plate 70 is disposed in the plating tank 50, so as to put the opening 73 between the substrate W and an anode 81. Further, the regulation plate 70 is disposed in the plating tank 50 with the annular protrusion 72 on the side of the substrate W. The shielding plate 71 is provided to shield an electric field formed between the anode 81 and the substrate W with a portion other than the opening 73. The opening 73 forms a path for the electric field to pass through, and has an opening size that can sufficiently limit the spread of the electric field and a length along the axial center.

The regulation plate 70 has two sensor parts 110*a* and 110*b*, and lighting devices 113*a* and 113*b* arranged corresponding to the respective sensor parts 110 on the side facing the substrate holder 11 (FIG. 2). The sensor parts 110*a* and 110*b* are disposed at positions respectively opposite to the image identification markers 120*a* and 120*b* of the substrate holder 11. The sensor parts 110*a* and 110*b* include projections 112 (112*a*, 112*b*) and cameras 111 (111*a*, 111*b*) disposed on the tip side of the projections 112 (FIG. 6). The camera 111 is an example of an image sensor. The image sensor is an example of an optical sensor. In the case of using a camera, it is preferable to set the position of the camera sufficiently close to the image identification marker and further provide illumination for illuminating the surroundings of the image identification marker, in order to make image identification possible for a colored plating solution. The protrusions 112 are disposed to bring the cameras 111 close to the image identification markers 120 of the substrate holder 11. In this way, the influence of the plating solution can be reduced and the cameras 111 can capture clearer images of the image identification markers 120. The lighting device 113 is a ring-shaped LED light source, for example, and when the camera 111 captures an image, the lighting device 113 can irradiate the image identification marker 120 to image the image identification marker 120 more clearly. If absence of the protrusion 112 does not cause a problem in the imaging of the image identification marker 120 performed by the camera 111, the protrusion 112 may not be disposed. In addition, if absence of the lighting device 113 does not cause a problem in the imaging of the image identification marker 120 performed by the camera 111, the lighting device 113 may not be disposed.

The anode holder 80 holds the anode 81 and is disposed opposite to the substrate holder 11 with the paddle 18 and the regulation plate 70 interposed therebetween. The substrate W and the anode 81 are electrically connected via a plating power source (not shown), and during the plating process, a current flows between the substrate W and the anode 81, so as to form a plating film on the surface of the substrate W. In this embodiment, an anode box 85 is disposed in the plating tank 50, and the anode holder 80 is disposed in the anode box 85. An opening is formed on a wall of the anode box 85 on the side of the anode 81 that faces the substrate W, and a diaphragm 86 is disposed on the opening. The anode 81 is disposed to be opposite to the substrate W with the diaphragm 86 interposed therebetween.

Figure 7:
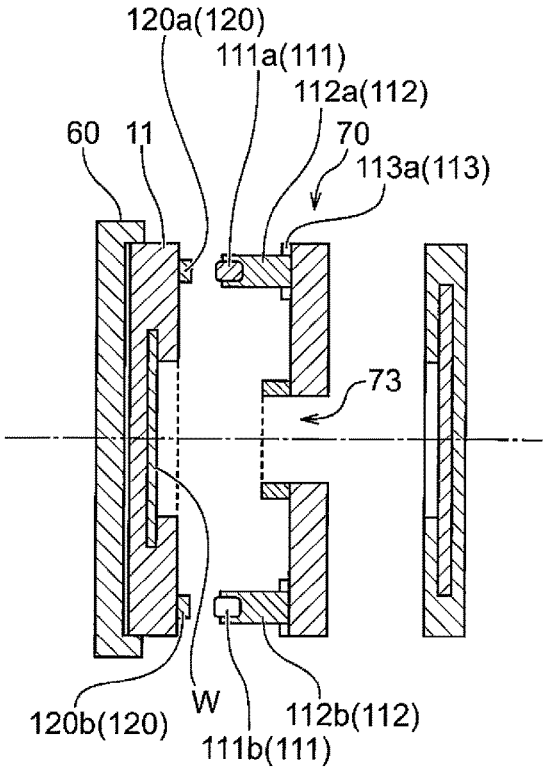
FIG. 7 is a view illustrating the position detection method for the substrate holder according to the first embodiment.

FIG. 7 is a view illustrating a position detection method for the substrate holder according to the first embodiment. In this embodiment, two image identification markers 120 (120*a*, 120*b*) are provided on the substrate holder 11 (FIG. 5 and FIG. 7), and two sensor parts 110 (110*a*, 110*b*) are provided on the regulation plate 70 (FIG. 6 and FIG. 7). In this method, before the operation of the plating apparatus, each image identification marker 120 (120*a*, 120*b*) at the time when the substrate holder 11 is placed in the correct position (predetermined position) in the plating tank 50 is imaged in advance to acquire the position information (target position) of the image identification markers 120 (120*a*, 120*b*) at this time. The cameras 111 (111*a*, 111*b*) are controlled by the controller 175, and the data of the position information (target position) of the image identification markers 120 (120*a*, 120*b*) is saved in the memory 175B. "Before the operation of the plating apparatus" means "before the plating process is executed by the plating apparatus," which for example includes the state of maintenance of the plating apparatus and other states when the plating apparatus stops the plating process.

Then, every time the substrate holder 11 is loaded and placed in the plating tank 50, the image identification marker 120 (120*a*, 120*b*) of the substrate holder 11 is imaged by the respective camera 111 (111*a*, 111*b*) of the regulation plate 70, the deviation of the position of each image identification marker 120 from the target position is measured, and whether the position of each image identification marker 120 matches the target position is determined before the plating process. If it is determined that the position of each image identification marker 120 matches the target position (including a case where the positions match within a predetermined allowable range), since the substrate holder 11 is in the correct position (predetermined position), a current is applied between the anode and the substrate and the plating process starts.

On the other hand, if it is determined that the position of at least one image identification marker 120 (120*a*, 120*b*) deviates from the target position, since the position of the substrate holder 11 deviates from the predetermined position, the movement amounts in the Y-axis direction, the Z-axis direction, and the rotational θ direction are calculated, and the actuators 102 to 104 are driven based on the calculated movement amounts to move the holder guide 60 (substrate holder 11) in each direction, so as to bring the position of each image identification marker 120 close to the target position (to bring the position of the substrate holder 11 close to the predetermined position). Thereafter, each image identification marker 120 of the substrate holder 11 is imaged by the respective camera 111 of the regulation plate 70, the deviation of the position of each image identification marker 120 from the target position is measured, and whether the position of each image identification marker 120 matches the target position is determined. These processes are repeated until the position of each image identification marker 120 matches the target position to place the substrate holder 11 in the predetermined position in the plating tank 50.

Instead of disposing the actuators 102 to 104, when it is determined that the position of the substrate holder 11 deviates from the predetermined position, the plating processing for this substrate holder 11 may be stopped and this substrate holder 11 may not be used in the subsequent plating processes. In that case, the plating process may be continued with another substrate holder 11, and the substrate holder 11 that has not been used may be readjusted or replaced when the plating apparatus is stopped. In the case where the actuators 101 are not provided, the substrate holder 11 may be suspended directly in the inner tank 52 without the holder guide 60. Moreover, the same process may be performed even when adjustment cannot be made by the actuators to make the position of each image identification marker 120 match the target position. In addition, instead of disposing the actuators 102 to 104, when it is determined that the position of the substrate holder 11 deviates from the predetermined position, this plating tank may not be used and the plating process may be performed in another plating tank.

FIG. 8 is a configuration example of the alignment data of the substrate holder. The alignment data (positioning data) includes the plating tank ID, the substrate holder ID, and the target position of each image identification marker 120 (120*a*, 120*b*) corresponding to the correct position (predetermined position) of the substrate holder. The plating tank ID is identification information for identifying each plating tank among the plating tanks 50. The substrate holder ID is identification information for identifying each substrate holder 11. The target position of each image identification marker 120 is position information acquired in advance by imaging each image identification marker 120 (120*a*, 120*b*) with the camera 111 when the substrate holder 11 is placed in the correct position (predetermined position) in the plating tank 50 before the operation of the plating apparatus. The target position includes the Y coordinate and the Z coordinate of the target position of each image identification marker 120 (120*a*, 120*b*). For example, when the plating tank ID=t1 and the substrate holder ID=h1, the target position of the image identification marker 120*a* is (y11*a*, z11*a*) and the target position of the image identification marker 120*b* is (y11*b*, z11*b*). Thus, by storing the target position of each image identification marker 120 in association with the respective plating tank and substrate holder, the substrate holder can be positioned more accurately in the plating tank corresponding to the individual difference of each substrate holder and the individual difference of each plating tank (including the individual differences and installation errors of the regulation plate, holder guide, etc.).

The alignment data may include the Y movement amounts, the Z movement amounts, and the θ movement amounts of the actuators 102 to 104. The Y movement amount is a movement amount (correction amount), by which the actuator 102 moves the holder guide 60 in the Y-axis direction when adjusting the position of the substrate holder 11. The Z movement amount is a movement amount (correction amount), by which the actuator 103 moves the holder guide 60 in the Z-axis direction when adjusting the position of the substrate holder 11. The θ movement amount is a movement amount (correction amount), by which the actuator 104 moves the holder guide 60 in the θ direction when adjusting the position of the substrate holder 11. With these movement amounts in the Y, Z, and θ directions stored, when the substrate holder 11 is positioned (position adjustment) with the same combination of substrate holder 11 and plating tank 50, the holder guide 60 (substrate holder 11) can be moved to the predetermined position quickly by using the movement amounts in the Y, Z, and θ directions of the previous positioning. Thereafter, again, whether the substrate holder 11 is in the predetermined position is determined by the imaging of the image identification marker 120 performed by the camera 111, and if there is a deviation, the substrate holder 11 is adjusted to the predetermined position by the actuators 102 to 104. Thereby, the positioning (position adjustment) of the substrate holder 11 can be carried out quickly. In the case where the actuators are not provided, the Y movement amount, the Z movement amount, and the 0 movement amount can be omitted from the alignment data.

Figure 9:
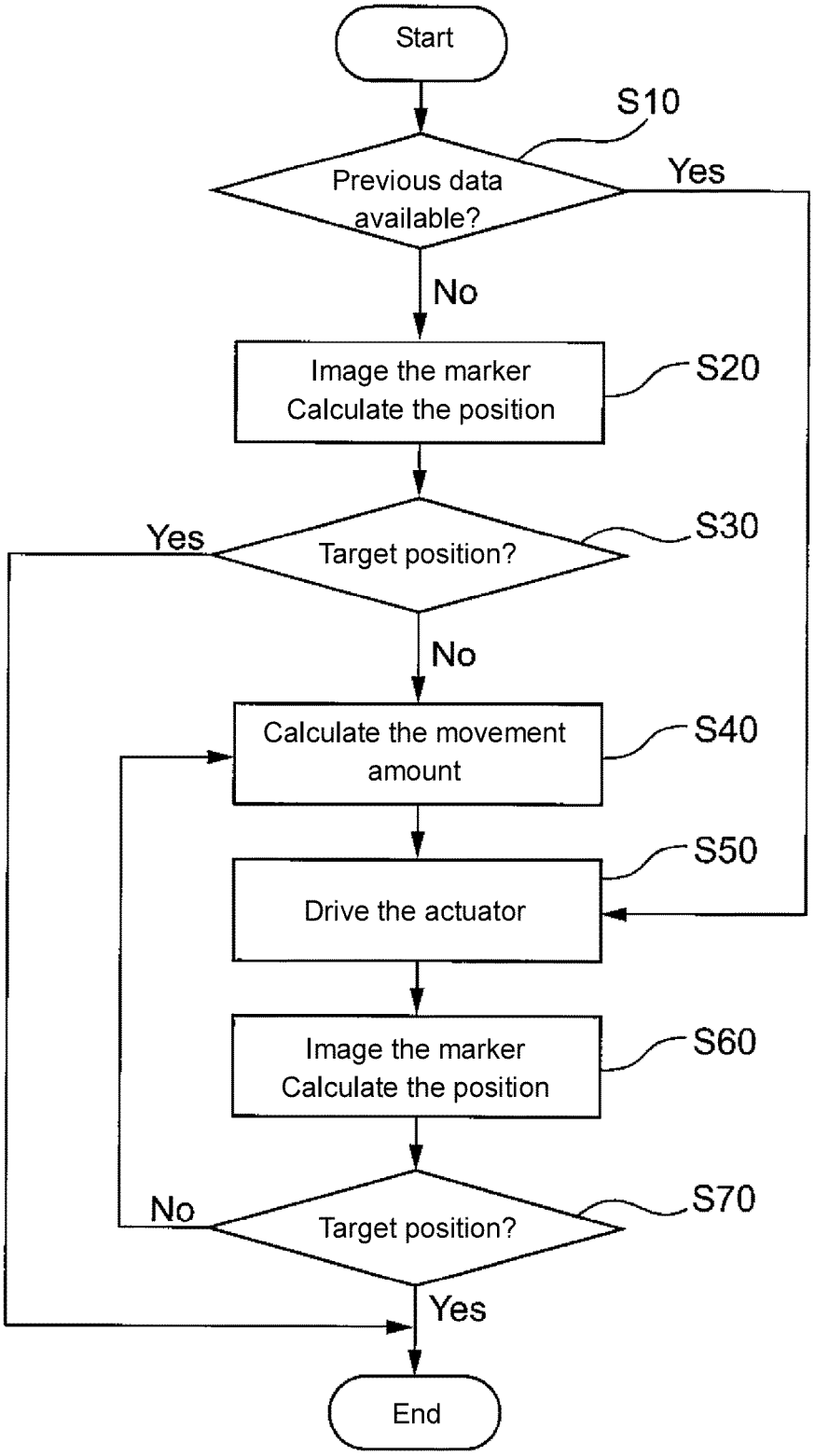
FIG. 9 is a flowchart of the positioning control according to the first embodiment.

FIG. 9 is a flowchart of positioning control. The following processing can be executed by the controller 175. Nevertheless, a part or all of the processing may be executed by other controllers. In this case, a part or all of the other controllers may be control parts realized by a combination of CPU and programs or control parts realized by hardware.

In S10, when the substrate holder 11 is loaded and placed in the plating tank 50 by the first transporter 142 or the second transporter 144, whether the Y movement amount, the Z movement amount, and the θ movement amount (previous data) corresponding to the IDs of the substrate holder 11 receiving the current positioning process and the plating tank 50 have been saved is determined with reference to the alignment data.

If it is determined in S10 that the previous data has not been saved, the processing proceeds to S20.

In S20, the image identification markers 120 (120*a*, 120*b*) are irradiated by the lighting devices 113 (113*a*, 113*b*) of the regulation plate 70, the image identification markers 120 (120*a*, 120*b*) of the substrate holder 11 are imaged by the cameras 111 (111*a*, 111*b*), and the position of each image identification marker 120 (120*a*, 120*b*) is calculated. The position of the substrate holder 11 includes the position in the Y-axis direction and the position in the Z-axis direction.

In S30, the predetermined position (target position) of the substrate holder 11 corresponding to the IDs of the substrate holder 11 receiving the current positioning process and the plating tank 50 is read from the alignment data (saved in the memory 175B, etc.), and the calculated position of the substrate holder 11 is compared with the target position to calculate the deviation from the target position of each image identification marker 120 (120*a*, 120*b*) and determine whether the deviation is within the predetermined allowable range. If the deviations of all the image identification markers 120 (120*a*, 120*b*) from the target position are within the predetermined allowable range, the substrate holder 11 is placed in the correct position and therefore the flow of the positioning process is ended. When the flow ends, each actuator may return to the initial position. On the other hand, if the deviation of any image identification marker 120 (120*a*, 120*b*) from the target position exceeds the predetermined allowable range, the processing proceeds to Step S40.

In S40, the Y movement amount, the Z movement amount, and the θ movement amount for bringing the calculated position of each image identification marker 120 (120*a*, 120*b*) close to the target position are calculated based on the calculated position of each image identification marker 120 (120*a*, 120*b*) acquired in S20 and the target position included in the alignment data.

In S50, the actuators 102 to 104 are driven based on the Y movement amount, the Z movement amount, and the θ movement amount of the previous data, and the holder guide 60 (substrate holder 11) is moved.

In S60, again, the image identification markers 120 (120*a*, 120*b*) of the substrate holder 11 are imaged by the cameras 111 (111*a*, 111*b*), and the position of each image identification marker 120 (120*a*, 120*b*) is calculated.

In S70, the calculated position of each image identification marker 120 (120*a*, 120*b*) is compared with the target position to calculate the deviation of each image identification marker 120 (120*a*, 120*b*) from the target position and determine whether the deviation is within the predetermined allowable range. If the deviations of all the image identification markers 120 (120*a*, 120*b*) from the target position are within the predetermined allowable range, the substrate holder 11 is placed in the correct position and therefore the flow of the positioning process is ended. When the flow ends, each actuator may return to the initial position. On the other hand, if the deviation of any image identification marker 120 (120*a*, 120*b*) from the target position exceeds the predetermined allowable range, the processing proceeds to Step S40. Then, the processing from S40 to S70 is repeated until the deviations of all the image identification markers 120 (120*a*, 120*b*) from the target position fall within the predetermined allowable range. If the deviations of all the image identification markers 120 (120*a*, 120*b*) from the target position are within the predetermined allowable range, the Y movement amounts, the Z movement amounts, and the θ movement amounts (the sum of the movement amounts in each direction) up to then are saved or updated and the flow of the positioning process is ended.

If it is determined in S10 that the previous data has been saved, the processing proceeds to S50.

In S50, the actuators 102 to 104 are driven based on the Y movement amount, the Z movement amount, and the θ movement amount of the previous data, and the holder guide 60 (substrate holder 11) is moved.

In S60, the image identification markers 120 (120*a*, 120*b*) of the substrate holder 11 are imaged by the cameras 111 (111*a*, 111*b*), and the position of each image identification marker 120 (120*a*, 120*b*) is calculated.

In S70, the calculated position of each image identification marker 120 (120*a*, 120*b*) is compared with the target position to calculate the deviation of each image identification marker 120 (120*a*, 120*b*) from the target position and determine whether the deviation is within the predetermined allowable range. If the deviations of all the image identification markers 120 (120*a*, 120*b*) from the target position are within the predetermined allowable range, the Y movement amounts, the Z movement amounts, and the θ movement amounts (the sum of the movement amounts in each direction) up to then are saved or updated and the flow of the positioning process is ended. When the flow ends, each actuator may return to the initial position. On the other hand, if the deviation of any image identification marker 120 (120*a*, 120*b*) from the target position exceeds the predetermined allowable range, the processing proceeds to Step S40. Then, the processing from S40 to S70 is repeated until the deviations of all the image identification markers 120 (120*a*, 120*b*) from the target position fall within the predetermined allowable range. If the deviations of all the image identification markers 120 (120*a*, 120*b*) from the target position are within the predetermined allowable range, the Y movement amounts, the Z movement amounts, and the θ movement amounts (the sum of the movement amounts in each direction) up to then are saved or updated and the flow of the positioning process is ended.

The above illustrates that the Y movement amount, the Z movement amount, and the θ movement amount are saved as the alignment data. However, if the Y movement amount, the Z movement amount, and the θ movement amount are not saved as the alignment data, S10 is omitted, and the process of saving the Y movement amount, the Z movement amount, and the θ movement amount at the end of the flow of the positioning process is also omitted. Furthermore, the process of confirming the previous data in S10 may be executed after S20 and S30.

In the above description, the substrate holder 11 is moved in the left-right direction (Y-axis direction), the up-down direction (Z-axis direction), and the rotational direction in the Y-Z plane (rotational θ direction) of the substrate holder 11. However, the substrate holder 11 may also be moved in the front-rear direction in addition to these directions or instead of some of these directions. When moved in the front-rear direction, the substrate holder 11 may be moved toward or away from the regulation plate 70 without changing the tilt in the front-rear direction, or may be rotated to change the tilt in the front-rear direction, or both.

Figure 16:
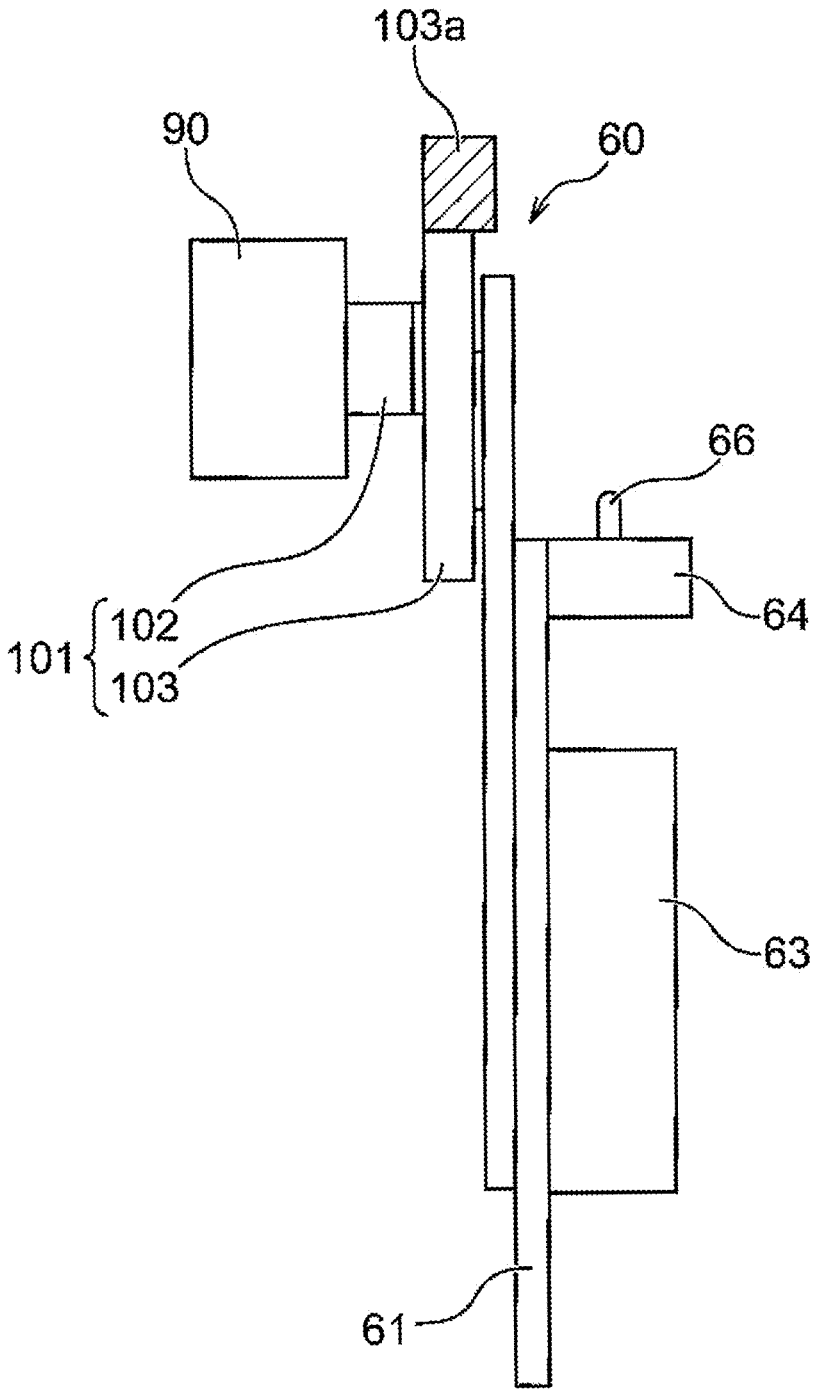
FIG. 16 is a side view of a modification of the substrate holder and the support mechanism thereof.

In the above description, the substrate holder 11 is moved in the left-right direction (Y-axis direction), the up-down direction (Z-axis direction), and the rotational direction in the Y-Z plane (rotational θ direction) of the substrate holder 11. However, the movement in the rotational θ direction may be omitted. In that case, the actuator 104 is omitted and the actuators 101 are composed of the actuators 102 and 103 (FIG. 16).

The above illustrates an example that the image identification markers 120 are disposed on the substrate holder 11 and the cameras 111 are disposed on the regulation plate 70. However, the cameras 111 may be disposed on the substrate holder 11 and the image identification markers 120 may be disposed on the regulation plate 70 instead.

The above illustrates an example that the positioning is performed by using the actuators to move the substrate holder 11. However, the positioning may also be performed by using actuators to move the regulation plate 70 instead.

The above illustrates that the substrate holder 11 is loaded and placed in the plating tank 50, and the position of the substrate holder 11 is detected and the positioning or position adjustment is performed before the plating process starts. However, the flow of FIG. 9 may be executed after the plating process starts. That is, the position of the substrate holder 11 is constantly monitored during the plating process, and the actuators may be driven to adjust the position of the substrate holder 11 whenever a deviation occurs.

The above illustrates that the deviation of the relative positions is corrected by the actuators. However, the deviation of the relative positions may also be corrected manually.

Figures 13, 14:
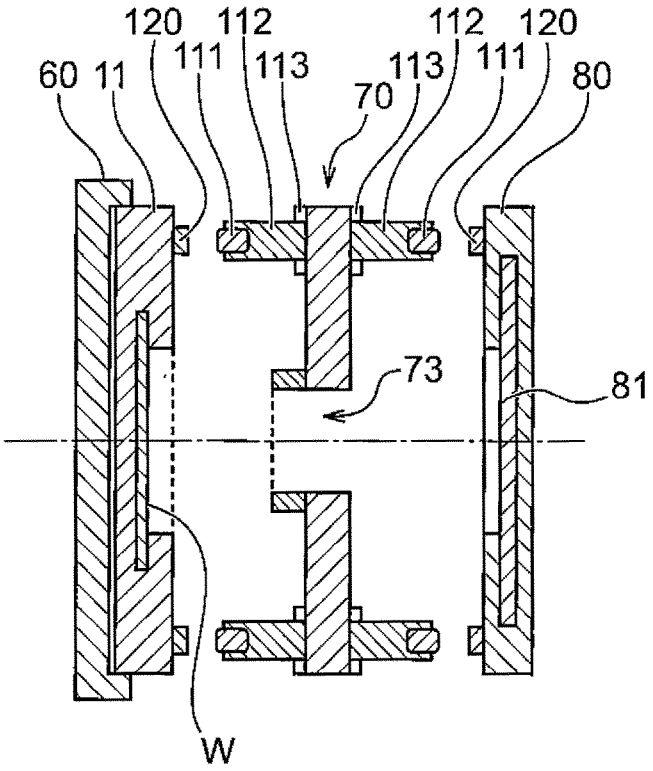
FIG. 13 is a configuration example of the alignment data according to the second embodiment.
FIG. 14 is a view illustrating the position detection method for the substrate holder according to a modification of the first embodiment.

The above illustrates the detection and positioning of the relative positions of the substrate holder 11 and the regulation plate 70. However, a process same as that for the substrate holder 11 and the regulation plate 70, as described above, may also be performed for the detection and positioning of the relative positions of the anode holder 80 and the regulation plate 70. In that case, as shown in FIG. 14, the image identification markers 120 are disposed on the surface of the anode holder 80 on the side of the regulation plate 70, as in the case of the substrate holder 11, and the sensor parts 110 (the cameras 111 and the protrusions 112) and the lighting devices 113 are disposed on the surface of the regulation plate 70 on the side of the anode holder 80. In addition, same as above, the actuators 101 (102 to 104) are disposed on the anode holder 80, and the same process as in FIG. 9 is performed so that the anode holder 80 can be positioned with respect to the regulation plate 70. Same as above, some of the actuators 101 (102 to 104) can be omitted, and an actuator for movement and rotation in the front-rear direction can be disposed in addition to the actuators 101 (102 to 104) or in place of some of the actuators 101 (102 to 104). Furthermore, the matters described above regarding the substrate holder 11 and the regulation plate 70 may also be applied to the anode holder 80 and the regulation plate 70. According to the configuration of FIG. 14, it is possible to perform detection, positioning, or position adjustment on the relative positions of the three members, i.e., the substrate holder 11, the regulation plate 70, and the anode holder 80. Same as above, the detection and positioning of the relative positions can be performed before the plating process or during the plating process. The detection and positioning of the relative positions of the anode holder 80 and the regulation plate 70 may be performed when the substrate holder 11 is not placed in the plating tank 50. In addition, the image identification markers 120 may be disposed on the surface of the regulation plate 70 on the side of the anode holder 80, as in the case of the substrate holder 11, and the sensor parts 110 (the cameras 111 and the protrusions 112) and the lighting devices 113 may be disposed on the surface of the anode holder 80 on the side of the regulation plate 70. Furthermore, instead of using the actuators to move the substrate holder 11 and the anode holder 80, the actuators may be used to move the substrate holder 11 and the regulation plate 70, or the actuators may be used to move the anode holder 80 and the regulation plate 70. By using the actuators to move any two of these members to adjust their positions, the relative positions of the three members can be adjusted to the desired positions.

Furthermore, the relative positions of two of the substrate holder 11, the regulation plate 70, and the anode holder 80 may be confirmed. In that case, one of the substrate holder 11, the regulation plate 70, and the anode holder 80 is set as a first member and another is set as a second member, and the image identification markers are disposed on one of the first member and the second member while the cameras are disposed on the other. Additionally, in order to adjust the relative positions of the first member and the second member, the actuators may be disposed on at least one of the first member and the second member. The relative positions of the two members may be monitored constantly to detect abnormality.

Furthermore, the relative positions of two of the substrate holder 11, the regulation plate 70, the anode holder 80, and the paddle 18 may be confirmed. In that case, one of the substrate holder 11, the regulation plate 70, the anode holder 80, and the paddle 18 is set as the first member and another is set as the second member, and the image identification markers are disposed on one of the first member and the second member while the cameras are disposed on the other. Additionally, in order to adjust the relative positions of the first member and the second member, the actuators may be disposed on at least one of the first member and the second member. Furthermore, the relative positions of three or four of the substrate holder 11, the regulation plate 70, the anode holder 80, and the paddle 18 may be confirmed. In order to adjust the relative positions of the members to be adjusted, the actuators may be disposed on at least one of the members. The relative positions of the members may be monitored constantly to detect abnormality.

According to the above embodiment, the relative positions of the members in the plating tank can be detected and/or adjusted without using a dedicated jig. Besides, since the relative positions of the members in the plating tank can be detected and/or adjusted prior to each plating process, abnormality of the relative positions of the members in the plating tank can be detected and/or corrected in an early stage. For example, since the position of the substrate holder 11 can be detected and adjusted every time the substrate holder 11 is placed in the plating tank 50, positioning abnormality can be detected and corrected in an early stage.

Second Embodiment

Figure 10:
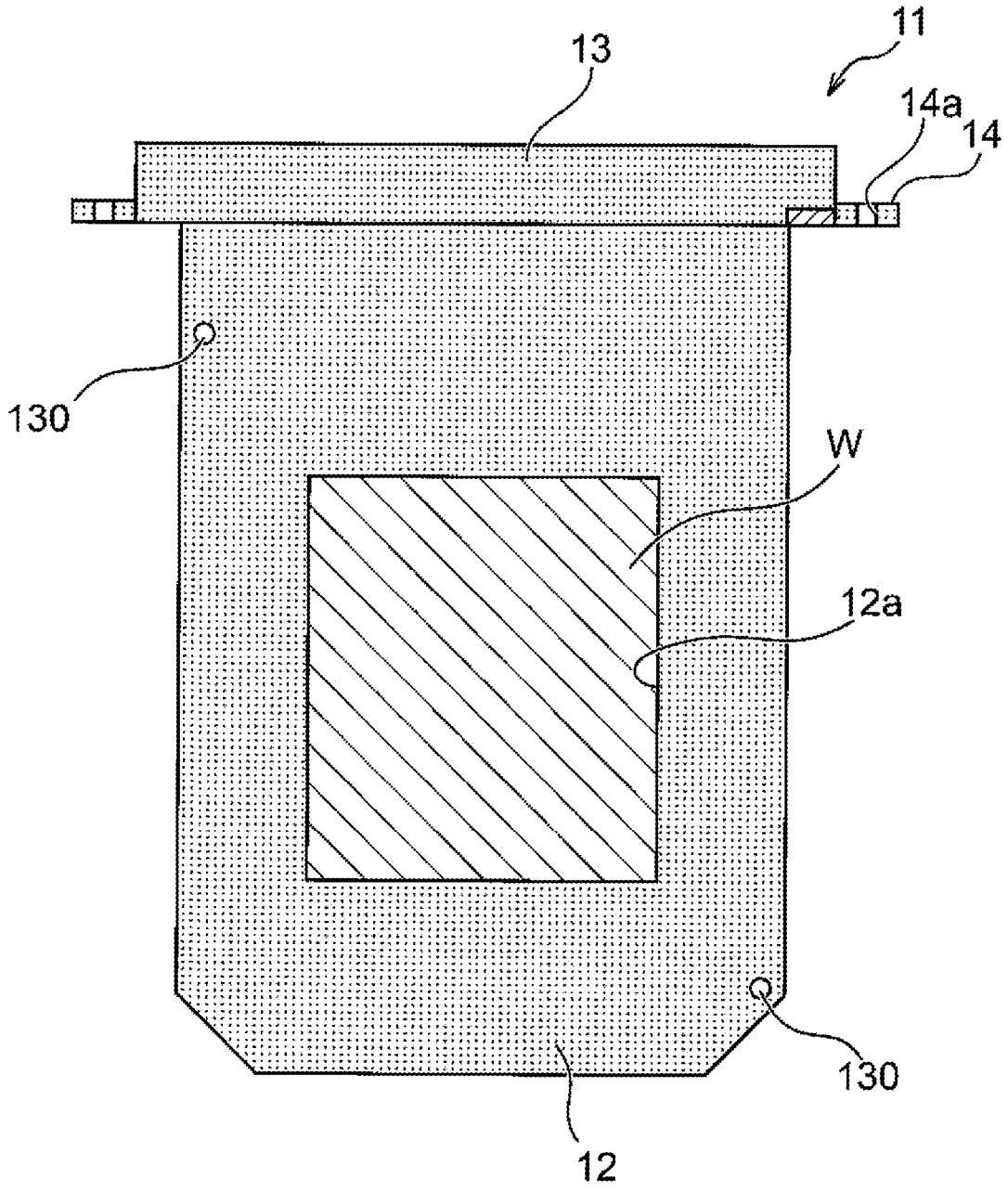
FIG. 10 is a front view of the substrate holder according to the second embodiment.
Figure 11:
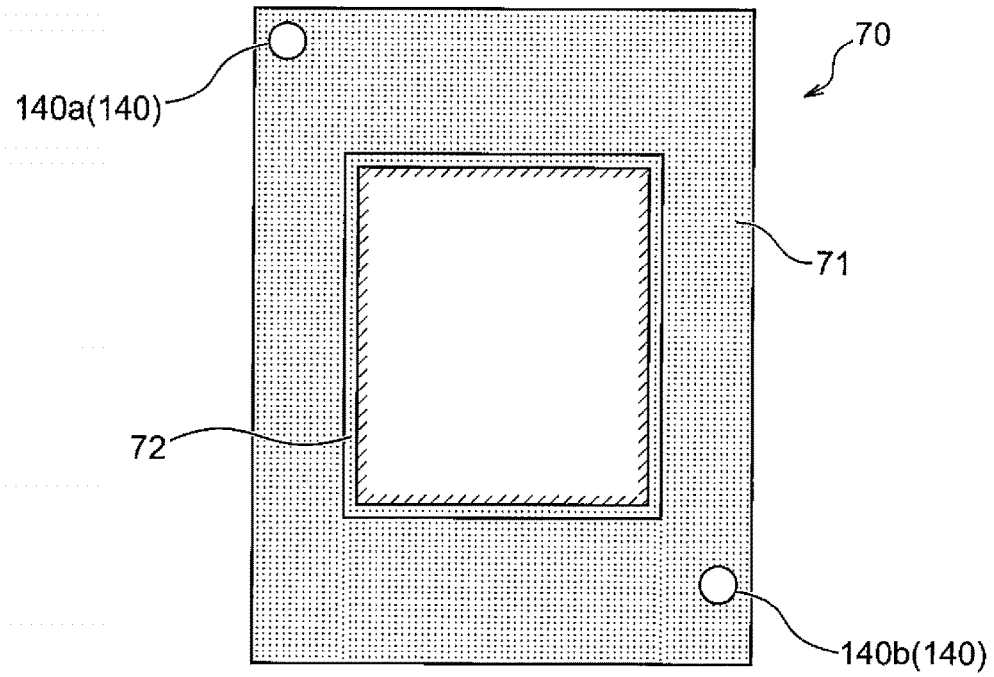
FIG. 11 is a front view of the regulation plate according to the second embodiment.
Figure 12:
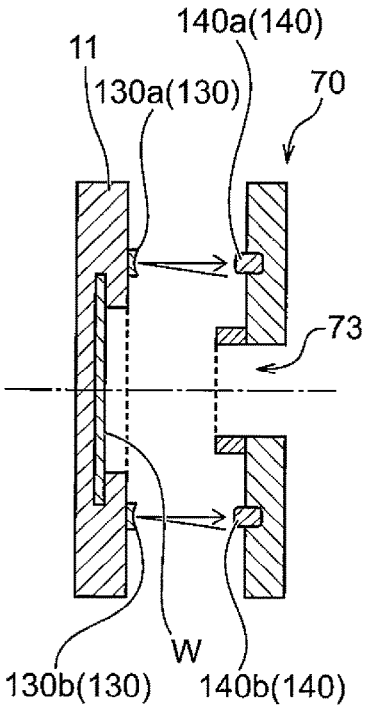
FIG. 12 is a view illustrating the position detection method for the substrate holder according to the second embodiment.

FIG. 10 is a front view of the substrate holder according to the second embodiment. FIG. 11 is a front view of the regulation plate according to the second embodiment. FIG. 12 is a view illustrating the position detection method for the substrate holder according to the second embodiment.

This embodiment is the same as the first embodiment, with the exception that a reflection member 130 is disposed in place of the image identification marker 120 (FIG. 10 and FIG. 12) and a reflection type optical sensor 140 is disposed on the regulation plate 70 in place of the camera 111 (FIG. 11 and FIG. 12). Therefore, points different from the first embodiment will be described hereinafter and descriptions of similar contents will be omitted. The reflection member 130 may be attached to the substrate holder 11 or be formed integrally with the substrate holder 11.

As shown in FIG. 12, an opening surface of the regulation plate 70 on the side of the substrate holder 11 and an opening surface of the substrate holder 11 on the side of the regulation plate 70 are parallel, and the correct position (predetermined position) of the substrate holder 11 is determined, so that a straight line, which passes through the center of the opening surface of the substrate holder 11 and is perpendicular to the substrate W, passes through the center of the opening surface of the regulation plate 70.

As shown in FIG. 10 to FIG. 12, the reflection members 130*a* and 130*b* (130) are disposed at at least two places on the surface of the substrate holder 11 that faces the regulation plate 70, and on the regulation plate 70, the optical sensors 140*a* and 140*b* (140) are disposed in positions respectively opposite to the reflection members 130*a* and 130*b* (130). Although the reflection members and the optical sensors are disposed at two places in this embodiment, they may be disposed at three or more places.

The reflection type optical sensor 140 detects the reflection member 130 by detecting a reflected light from the reflection member 130. In other words, the reflection type optical sensor 140 detects that the optical sensor 140 and the reflection member 130 face each other in the correct orientation and position (the arrangement that they face each other with the optical axis of the optical sensor 140 perpendicular to the reflection member 130) based on the detected intensity of the reflected light from the reflection member 130. The relative positions can be measured, for example, based on whether the intensity of the reflected light from each reflection member 130 detected by the optical sensor 140 is equal to or more than a threshold value. The orientation can be measured, for example, based on the difference in the intensity of the reflected light from each reflection member 130 detected by the optical sensor 140. The reflection type optical sensor 140 can be a reflection type laser sensor that includes a light source for outputting a laser beam and a light receiving part for receiving a reflected wave of the laser beam, for example. Nevertheless, any type of optical sensor can serve as the reflection type optical sensor 140 if it can output light and detect the reflected wave thereof. For the light source of the optical sensor 140 used for detection, it is preferable to select and use a wavelength range where light absorption of the plating solution to be used is sufficiently small. When a copper sulfate plating solution is used, for example, the wavelength of the light of the optical sensor 140 is preferably in a range of 350 nm or more and 600 nm or less, or 900 nm or more and 1,000 nm or less; and when a Ni plating solution is used, the wavelength is preferably in a range of 450 nm or more and 600 nm or less, or 900 nm or more and 1,000 nm or less.

If the reflection member 130 is, for example, a reflection plate having a planar reflective surface, the reflective surface is set parallel to the opening surface of the substrate holder. The optical sensor 140 is disposed with the optical axis perpendicular to the opening surface of the regulation plate 70. Thereby, the opening surface of the regulation plate 70 on the side of the substrate holder 11 and the opening surface of the substrate holder 11 on the side of the regulation plate 70 are parallel, and when the substrate holder 11 is placed in the correct position (predetermined position) to allow the straight line, which passes through the center of the opening surface of the substrate holder 11 and is perpendicular to the substrate W, to pass through the center of the opening surface of the regulation plate 70, the light emitted from the optical sensor 140 is reflected by the reflection plate 130 into the light receiving part in the optical sensor and detected, by which the light is detected with the maximum intensity. At this time, the size of the reflection plate 130 disposed on the substrate holder 11 and the beam diameter of the optical sensor 140 are made sufficiently small, and the surface of the substrate holder 11 around the reflection plate 130 is in a state that does not reflect the light (or hardly reflects the light). Thus, it is possible to detect not only the orientation (parallelism) of the substrate holder 11 and the regulation plate 70 but also the deviation of the relative positions. The relative positions/orientation of the substrate holder 11 and the regulation plate 70 can be determined based on the intensity detected by the optical sensor 140 and can be determined according to whether it exceeds a preset threshold value. For example, if the intensity detected by some of the optical sensors 140 does not exceed the threshold value, it is determined that the substrate holder 11 tilts. The orientation may be determined based on the difference in the intensity detected by the optical sensor 140.

In addition, a mirror, such as a concave mirror, can be used as the reflection member 130. When the concave mirror is used, it is preferable to make the distance from the optical sensor 140 to the concave mirror (reflection member 130) consistent with a focal distance of the concave mirror. In this way, the position detection sensitivity and accuracy can be improved. This configuration is achieved by selecting the concave mirror and changing the height at which the optical sensor 140 is disposed on the regulation plate 70. The height at which the optical sensor 140 is disposed on the regulation plate 70 can be changed by disposing a protrusion on the regulation plate 70 to bring the optical sensor 140 close to the substrate holder 11, or forming a concave on the regulation plate 70 to embed a part or all of the optical sensors 140.

In this embodiment, as shown in FIG. 12, the intensity of the light reflected by the reflection members 130 (130*a*, 130*b*) on the substrate holder 11 is detected by the optical sensors 140 (140*a*, 140*b*) on the regulation plate 70. Before the operation of the plating apparatus, the intensity detected by each optical sensor 140 when the substrate holder 11 is placed in the correct position (predetermined position) is saved as the threshold value for the combination of each plating tank 50 and each substrate holder 11 in advance. A value lower than the intensity, detected by each optical sensor 140 when the substrate holder 11 is placed in the correct position (predetermined position), by a predetermined allowable range may also be set as the threshold value.

FIG. 13 is an example of the alignment data according to the second embodiment. In this embodiment, as the predetermined position of the substrate holder 11, the intensity detected by each of the optical sensors 140*a* and 140*b* when the substrate holder 11 is placed in the correct position is stored as the threshold value (c, d). For example, the threshold value corresponding to the plating tank ID=t1 and the substrate holder ID=h1 is (c11, d11). When the substrate holder 11 is loaded and placed in the plating tank 50, based on the IDs of the substrate holder 11 and the plating tank 50, the corresponding threshold value (c, d) is read with reference to the alignment data and compared with the intensity detected by each of the optical sensors 140*a* and 140*b*. If the intensities detected by all the optical sensors 140*a* and 140*b* are equal to or more than the threshold value (c, d), it can be determined that the substrate holder 11 is placed in the predetermined position. On the other hand, if the intensity detected by at least one of the optical sensors 140*a* and 140*b* is less than the threshold value (c, d), it can be determined that the substrate holder 11 deviates from the predetermined position or tilts.

Thereby, whether the substrate holder 11 is in the correct position (predetermined position) and orientation can be determined. Therefore, during the operation of the plating apparatus, whether the substrate holder 11 is placed in the correct position can be determined before the plating process every time the substrate holder 11 is loaded and placed in the plating tank 50. Since the position of the substrate holder 11 can be detected and confirmed every time the substrate holder 11 is placed in the plating tank 50, positioning abnormality can be detected in an early stage. When it is determined that the position of the substrate holder 11 deviates from the predetermined position, the plating processing for this substrate holder 11 may be stopped and this substrate holder 11 may not be used in the subsequent plating processes. In that case, the plating process may be continued with another substrate holder 11, and the substrate holder 11 that has not been used may be readjusted or replaced when the plating apparatus is stopped. In that case, the configuration of the actuators 101 of the first embodiment may be omitted. As in the first embodiment, the substrate holder 11 or the regulation plate 70 may be moved by actuators to adjust the position of the substrate holder 11 to the predetermined position. In that case, as in the first embodiment, the data of the previous movement amounts of the actuators (Y movement amount, Z movement amount, θ movement amount, etc.) may be included in the alignment data. In addition, as in the first embodiment, when it is determined that the position of the substrate holder 11 deviates from the predetermined position, the plating process to be performed in this plating tank may be stopped so as to perform the plating process in another plating tank.

The above illustrates an example that the reflection members 130 are disposed on the substrate holder 11 and the optical sensors 140 are disposed on the regulation plate 70. However, the optical sensors 140 may be disposed on the substrate holder 11 and the reflection members 130 may be disposed on the regulation plate 70 instead.

Figure 15:
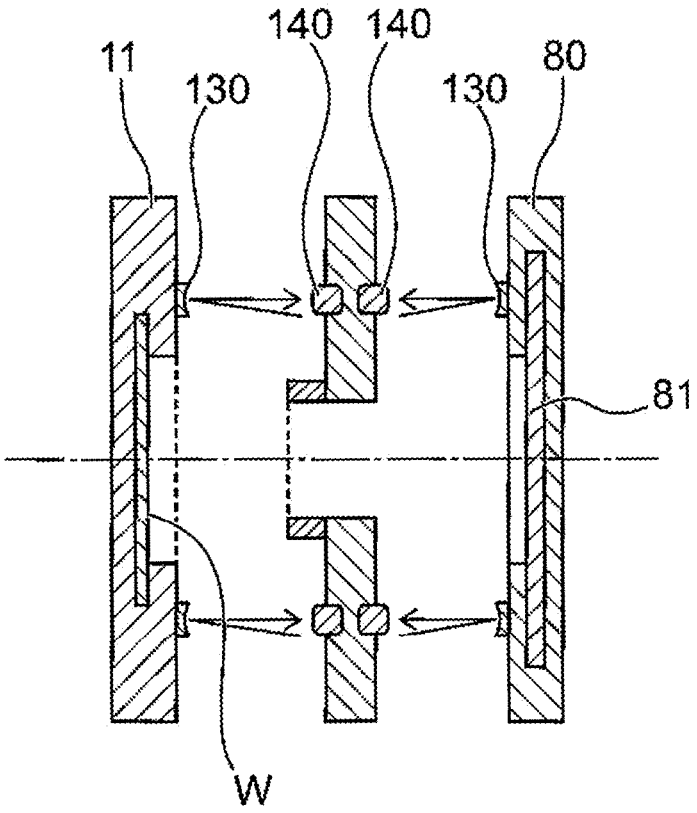
FIG. 15 is a view illustrating the position detection method for the substrate holder according to a modification of the second embodiment.

FIG. 15 is a view illustrating the position detection method for the substrate holder according to a modification of the second embodiment. The above illustrates the detection and positioning of the relative positions of the substrate holder 11 and the regulation plate 70. However, a process same as that for the substrate holder 11 and the regulation plate 70, as described above, may also be performed for the detection and positioning of the relative positions of the anode holder 80 and the regulation plate 70. In that case, as shown in FIG. 15, the reflection members 130 are disposed on the surface of the anode holder 80 on the side of the regulation plate 70, as in the case of the substrate holder 11, and the optical sensors 140 are disposed on the surface of the regulation plate 70 on the side of the anode holder 80. In addition, same as above, the anode holder 80 can be moved by actuators to be positioned with respect to the regulation plate 70. Same as above, some of the actuators 101 (102 to 104) can be omitted, and an actuator for movement and rotation in the front-rear direction can be disposed in addition to the actuators 101 (102 to 104) or in place of some of the actuators 101 (102 to 104). Furthermore, the matters described above regarding the substrate holder 11 and the regulation plate 70 may also be applied to the anode holder 80 and the regulation plate 70. According to the configuration of FIG. 15, it is possible to perform detection and positioning on the relative positions of the three members, i.e., the substrate holder 11, the regulation plate 70, and the anode holder 80. Same as above, the detection and positioning of the relative positions can be performed before the plating process or during the plating process. The detection and positioning of the relative positions of the anode holder 80 and the regulation plate 70 may be performed when the substrate holder 11 is not placed in the plating tank 50. In addition, the reflection members 130 may be disposed on the surface of the regulation plate 70 on the side of the anode holder 80, as in the case of the substrate holder 11, and the optical sensors 140 may be disposed on the surface of the anode holder 80 on the side of the regulation plate 70. Furthermore, instead of using the actuators to move the substrate holder 11 and the anode holder 80, the actuators may be used to move the substrate holder 11 and the regulation plate 70, or the actuators may be used to move the anode holder 80 and the regulation plate 70. By using the actuators to move any two of these members to adjust their positions, the relative positions of the three members can be adjusted to the desired positions.

Furthermore, the relative positions and/or orientation of two of the substrate holder 11, the regulation plate 70, and the anode holder 80 may be confirmed. In that case, one of the substrate holder 11, the regulation plate 70, and the anode holder 80 is set as a first member and another is set as a second member, and the reflection members are disposed on one of the first member and the second member while the optical sensors are disposed on the other. Additionally, in order to adjust the relative positions and/or orientation of the first member and the second member, the actuators may be disposed on at least one of the first member and the second member. The relative positions of the two members may be monitored constantly to detect abnormality.

Furthermore, the relative positions of two of the substrate holder 11, the regulation plate 70, the anode holder 80, and the paddle 18 may be confirmed. In that case, one of the substrate holder 11, the regulation plate 70, the anode holder 80, and the paddle 18 is set as the first member and another is set as the second member, and the reflection members are disposed on one of the first member and the second member while the optical sensors are disposed on the other. Additionally, in order to adjust the relative positions and/or orientation of the first member and the second member, the actuators may be disposed on at least one of the first member and the second member. Furthermore, the relative positions of three or four of the substrate holder 11, the regulation plate 70, the anode holder 80, and the paddle 18 may be confirmed. Additionally, in order to adjust the relative positions and/or orientation of the members to be adjusted, the actuators may be disposed on at least one of the members. The relative positions of the members may be monitored constantly to detect abnormality.

According to the above embodiment, the relative positions of the members in the plating tank can be detected and/or adjusted without using a dedicated jig. Besides, since the relative positions and/or orientation of the members in the plating tank can be detected and/or adjusted prior to each plating process, abnormality of the relative positions and/or orientation of the members in the plating tank can be detected and/or corrected in an early stage. For example, since the position of the substrate holder 11 can be detected and adjusted every time the substrate holder 11 is placed in the plating tank 50, positioning abnormality can be detected and corrected in an early stage.

Regarding the substrate to be processed by the plating apparatus, in some cases, multiple types of substrates having different circuit patterns formed thereon are processed. In such cases, the optimal positional relationship between the relative positions of at least two of the substrate holder 11, the regulation plate 70, the anode holder 80, and the paddle 18 may differ between these types of substrates. For example, it is considered that, even if the substrate holder 11 and the regulation plate 70 are positioned for a certain substrate A, when a substrate B is processed, shifting the regulation plate 70 in the up-down direction by a few millimeters may improve the in-plane uniformity of the plating. Therefore, the alignment data may keep a unique value for each type of substrate. It is considered that the relative positions of at least two of the substrate holder 11, the regulation plate 70, the anode holder 80, and the paddle 18 that have been adjusted to the optimum for a certain type of substrate, and the optimal relative positions for other types of substrates often differ by a certain distance or angle. Therefore, a constant value may be added to or subtracted from the alignment data generated for a certain substrate to generate the alignment data to be used on other types of substrates.

At least the following technical ideas are grasped from the above embodiments. According to form 1, a plating apparatus for applying a plating process on a substrate by using a substrate holding member is provided. The plating apparatus includes a plating tank; a first member disposed in the plating tank at a position opposite to the substrate holding member when the substrate holding member is placed in the plating tank; an optical sensor disposed on one of the substrate holding member and the first member; and a plurality of detected parts disposed on the other of the substrate holding member and the first member to be detectable by the optical sensor.

According to form 1, whether the substrate holding member is in the predetermined position in the plating tank can be confirmed without using a dedicated jig. Since the optical sensor is disposed on one of the substrate holding member and the first member while the detected part is disposed on the other, whether the substrate holding member is in the predetermined position in the plating tank can be confirmed every time the substrate holding member is placed in the plating tank. Since the position of the substrate holding member can be detected and confirmed every time the substrate holding member is placed in the plating tank, positioning abnormality can be detected in an early stage. As a result, the uniformity of the plating film thickness formed by the plating process can be improved and the yield can be prevented from dropping. In addition, according to this embodiment, for each plating process (every time the substrate holding member is placed in the plating tank), it is possible to directly check the position of the substrate holding member prior to the plating process without stopping the plating apparatus.

According to form 2, in the plating apparatus of form 1, the detected part is a reflection member. By using a reflection type optical sensor, the detected part can be easily detected.

According to form 3, in the plating apparatus of form 2, the detected part is a concave mirror and a focal distance of the concave mirror is equal to a distance between the concave mirror and the optical sensor. According to form 3, the position detection sensitivity and accuracy of the optical sensor can be improved.

According to form 4, in the plating apparatus of form 1, the optical sensor is an image sensor and the detected parts are a plurality of image identification markers. According to form 4, the position of the substrate holding member can be detected by using the image sensor to detect the image identification markers. In addition, it is possible to measure the deviation of the detected position from the target position.

According to form 5, the plating apparatus of form 4 further includes a control device that calculates a position of the substrate holding member by imaging the image identification markers with the image sensor. The position of the substrate holding member includes at least one of a position in each axial direction of two axes that are orthogonal to each other in a plane parallel to the substrate, a position in a rotational direction in the plane parallel to the substrate, a position in a front-rear direction perpendicular to the substrate, and a position in a rotational direction in a plane perpendicular to the substrate. According to form 5, the position of the substrate holding member in at least one direction of the position (Y, Z) in each axial direction of two axes that are orthogonal to each other in the plane parallel to the substrate, the position (θ) in the rotational direction in the plane parallel to the substrate, the position (X) in the front-rear direction perpendicular to the substrate, and the position (φ) in the rotational direction in the plane perpendicular to the substrate can be calculated by imaging the image identification markers with the image sensor.

According to form 6, the plating apparatus of any one of forms 1 to 5 further includes a first actuator capable of moving the substrate holding member in each axial direction of the two axes that are orthogonal to each other in the plane parallel to the substrate. According to form 6, the position of the substrate holding member in two orthogonal axial directions can be adjusted by the first actuator.

According to form 7, the plating apparatus of 6 further includes a second actuator capable of rotating the substrate holding member in the rotational direction in the plane parallel to the substrate. According to form 7, the position of the substrate holding member in the rotational direction can be adjusted by the second actuator.

According to form 8, the plating apparatus of form 1 further includes a control device that determines whether the substrate holding member is in a predetermined position in the plating tank by detecting the detected parts with the optical sensor. According to form 8, whether the substrate holding member is in the predetermined position in the plating tank can be determined automatically by the control device.

According to form 9, the plating apparatus of form 6 further includes a control device that controls movement of the substrate holding member caused by the first actuator based on a detection result of the detected parts acquired by the optical sensor. According to form 9, the movement of the substrate holding member caused by the first actuator can be controlled accurately by the control device.

According to form 10, the plating apparatus of form 7 further includes a control device that controls movement of the substrate holding member caused by the first actuator and the second actuator based on a detection result of the detected parts acquired by the optical sensor. According to form 10, the movement of the substrate holding member caused by the second actuator can be controlled accurately by the control device.

According to form 11, in the plating apparatus of form 9, a plurality of substrate holding members are used and a plurality of plating tanks are disposed. The predetermined position of the substrate holder (the target position of the detected part) is stored in association with identification information of the substrate holding member and identification information of the plating tank, and the control device controls movement of the substrate holding member caused by the first actuator based on the predetermined position corresponding to the identification information of the substrate holding member and the identification information of the plating tank. According to form 11, since the predetermined position of the substrate holding member in the plating tank (the target position of the detected part) is stored in association with the respective substrate holding member and plating tank, the position of the substrate holding member in the plating tank can be set according to the individual differences of the substrate holding member and the plating tank. In addition, by storing the driving amounts (the movement amounts in the Y and Z directions) of the first actuator in association with each substrate holding member and each plating tank, it is possible to improve the efficiency of position adjustment for the subsequent processes. Further, if the predetermined position associated with each substrate holding member and each plating tank and the driving amounts of the first actuator are monitored and updated constantly, the substrate holding member can always be kept in a proper position and consequently the plating quality can be maintained.

According to form 12, in the plating apparatus of form 10, a plurality of substrate holding members are used and a plurality of plating tanks are disposed. The predetermined position of the substrate holder (the target position of the detected part) is stored in association with identification information of the substrate holding member and identification information of the plating tank, and the control device controls movement of the substrate holding member caused by the first actuator and the second actuator based on the predetermined position corresponding to the identification information of the substrate holding member and the identification information of the plating tank. According to form 12, since the predetermined position of the substrate holding member in the plating tank (the target position of the detected part) is stored in association with the respective substrate holding member and plating tank, the position of the substrate holding member in the plating tank can be set according to the individual differences of the substrate holding member and the plating tank. In addition, by storing the driving amounts (the movement amounts in the Y, Z, and θ directions) of the first and second actuators in association with each substrate holding member and each plating tank, it is possible to improve the efficiency of position adjustment for the subsequent processes. Further, if the predetermined position associated with each substrate holding member and each plating tank and the driving amounts of the first and second actuators are monitored and updated constantly, the substrate holding member can always be kept in a proper position and consequently the plating quality can be maintained.

According to form 13, in the plating apparatus of any one of forms 1 to 12, the optical sensor is disposed on the first member. According to form 13, by disposing the optical sensor on the first member, instead of the substrate holding members that need to be prepared in a large number considering the productivity, the costs can be kept low.

According to form 14, in the plating apparatus of any one of forms 1 to 13, the first member is a regulation plate or an anode holder. According to form 14, by positioning the substrate holding member with respect to the regulation plate and/or the anode holder, good plating quality can be maintained.

According to form 15, in the plating apparatus of any one of forms 1 to 12, the first member is a regulation plate, an anode holder is further disposed in the plating tank, the optical sensor is disposed on the regulation plate, and the detected parts are disposed on the substrate holding member and the anode holder. According to form 15, the optical sensor is disposed on the regulation plate disposed between the substrate holding member and the anode holder for detecting the detected parts on the substrate holding member and the anode holder, by which the positioning of the substrate holding member with respect to the regulation plate and the anode plate can be carried out efficiently.

According to form 16, a recording medium storing a program for executing a control method of a plating apparatus is provided. When a substrate holding member that holds a substrate is placed opposite to a first member in a plating tank, the program stored in the recording medium enables a computer to determine whether the substrate holding member is in a predetermined position in the plating tank by detecting, with an optical sensor disposed on one of the substrate holding member and the first member, a detected part disposed on the other of the substrate holding member and the first member. According to form 16, since the optical sensor is disposed on one of the substrate holding member and the first member while the detected part is disposed on the other, whether the substrate holding member is in the predetermined position in the plating tank can be confirmed every time the substrate holding member is placed in the plating tank. Since the position of the substrate holding member can be detected and confirmed every time the substrate holding member is placed in the plating tank, positioning abnormality can be detected in an early stage. As a result, the uniformity of the plating film thickness formed by the plating process can be improved and the yield can be prevented from dropping. When a dedicated jig is used, it is necessary to stop the plating apparatus to dispose the jig in place of the substrate holding member in the plating tank. According to this embodiment, however, for each plating process (every time the substrate holding member is placed in the plating tank), it is possible to directly check the position of the substrate holding member prior to the plating process without stopping the plating apparatus.

According to form 17, the recording medium of form 16 stores the program for further enabling the computer to move the substrate holding member in at least one direction of a position in each axial direction of two axes that are orthogonal to each other in a plane parallel to the substrate, a position in a rotational direction in the plane parallel to the substrate, a position in a front-rear direction perpendicular to the substrate, and a position in a rotational direction in a plane perpendicular to the substrate, based on a detection result of the detected part acquired by the optical sensor. According to form 17, the substrate holding member can be moved in at least one direction of the position (Y, Z) in each axial direction of two axes that are orthogonal to each other in the plane parallel to the substrate, the position (θ) in the rotational direction in the plane parallel to the substrate, the position (X) in the front-rear direction perpendicular to the substrate, and the position (φ) in the rotational direction in the plane perpendicular to the substrate, so as to be positioned.

According to form 18, a plating apparatus for applying a plating process on a substrate is provided. The plating apparatus includes a plating tank; a first member disposed in the plating tank; a second member disposed opposite to the first member in the plating tank; an optical sensor disposed on one of the first member and the second member; and a plurality of detected parts disposed on the other of the first member and the second member to be detectable by the optical sensor. According to form 18, the relative positions and/or orientation of the first member and the second member can be detected and/or adjusted without using a dedicated jig. The first member and the second member are, for example, two of the substrate holder, the paddle, the regulation plate, and the anode holder. Actuators may be disposed on at least one of the first member and the second member for adjusting the relative positions and/or orientation. Instead of disposing actuators, the relative positions and/or orientation may also be adjusted manually.

Although the embodiments of the disclosure have been described above based on several examples, the embodiments described above are provided to facilitate understanding of the disclosure and should not be construed as limitations to the disclosure. The disclosure may be modified and improved without departing from the spirit of the disclosure, and it goes without saying that the scope of the disclosure covers the equivalents thereof. Moreover, it is possible to combine the components/elements described in the claims and the specification in any manner in the range where at least some of the aforementioned problems can be solved or in the range where at least some of the effects are achieved, or to omit some components/elements.

What is claimed is:

1. A plating apparatus for applying a plating process on a substrate by using a substrate holding member, the plating apparatus comprising:

a plating tank;

a first member disposed in the plating tank at a position opposite to the substrate holding member when the substrate holding member is placed in the plating tank;

an optical sensor disposed on one of the substrate holding member and the first member; and a plurality of detected parts disposed on the other of the substrate holding member and the first member to be detectable by the optical sensor.

2. The plating apparatus according to claim 1, wherein each of detected parts is a reflection member.

3. The plating apparatus according to claim 2, wherein each of the detected parts is a concave mirror, and a focal distance of the concave mirror is equal to a distance between the concave mirror and the optical sensor.

4. The plating apparatus according to claim 1, wherein the optical sensor is an image sensor, and the detected parts are a plurality of image identification markers.

5. The plating apparatus according to claim 4, further comprising:

a control device that calculates a position of the substrate holding member by imaging the image identification markers with the image sensor, wherein the position of the substrate holding member comprises at least one of a position in each axial direction of two axes that are orthogonal to each other in a plane parallel to the substrate, a position in a rotational direction in the plane parallel to the substrate, a position in a front-rear direction perpendicular to the substrate, and a position in a rotational direction in a plane perpendicular to the substrate.

6. The plating apparatus according to claim 5, further comprising:

a first actuator capable of moving the substrate holding member in each axial direction of the two axes that are orthogonal to each other in the plane parallel to the substrate.

7. The plating apparatus according to claim 6, further comprising:

a second actuator capable of rotating the substrate holding member in the rotational direction in the plane parallel to the substrate.

8. The plating apparatus according to claim 1, further comprising:

a control device that determines whether the substrate holding member is in a predetermined position in the plating tank by detecting the detected parts with the optical sensor.

9. The plating apparatus according to claim 6, further comprising:

a control device that controls movement of the substrate holding member caused by the first actuator based on a detection result of the detected parts acquired by the optical sensor.

10. The plating apparatus according to claim 7, further comprising:

a control device that controls movement of the substrate holding member caused by the first actuator and the second actuator based on a detection result of the detected parts acquired by the optical sensor.

11. The plating apparatus according to claim 9, wherein a plurality of substrate holding members are used and a plurality of plating tanks are disposed, the predetermined position is stored in association with identification information of the substrate holding member and identification information of the plating tank, and the control device controls movement of the substrate holding member caused by the first actuator based on the predetermined position corresponding to the identification information of the substrate holding member and the identification information of the plating tank.

12. The plating apparatus according to claim 10, wherein a plurality of substrate holding members are used and a plurality of plating tanks are disposed, the predetermined position is stored in association with identification information of the substrate holding member and identification information of the plating tank, and the control device controls movement of the substrate holding member caused by the first actuator and the second actuator based on the predetermined position corresponding to the identification information of the substrate holding member and the identification information of the plating tank.

13. The plating apparatus according to claim 1, wherein the optical sensor is disposed on the first member.

14. The plating apparatus according to claim 1, wherein the first member is a regulation plate or an anode holder.

15. The plating apparatus according to claim 1, wherein the first member is a regulation plate, an anode holder is further disposed in the plating tank, the optical sensor is disposed on the regulation plate, and the detected parts are disposed on the substrate holding member and the anode holder.

16. A plating apparatus for applying a plating process on a substrate, the plating apparatus comprising:

a plating tank;

a first member disposed in the plating tank;

a second member disposed opposite to the first member in the plating tank;

an optical sensor disposed on one of the first member and the second member; and a plurality of detected parts disposed on the other of the first member and the second member to be detectable by the optical sensor.

* * * * *